US006584885B2

(12) United States Patent
Lou

(10) Patent No.: US 6,584,885 B2
(45) Date of Patent: Jul. 1, 2003

(54) VARIABLE LIFT ACTUATOR

(75) Inventor: Zheng Lou, Plymouth, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/879,576

(22) Filed: Jun. 12, 2001

(65) Prior Publication Data

US 2002/0184996 A1 Dec. 12, 2002

(51) Int. Cl.[7] ..... F01B 31/14
(52) U.S. Cl. ..... 92/60; 92/85 B
(58) Field of Search ..... 92/51, 60, 85 R, 92/85 B, 80, 82, 135, 130 C, 143; 91/172, 173

(56) References Cited

U.S. PATENT DOCUMENTS

| | | | | |
|---|---|---|---|---|
| 2,398,997 A | | 4/1946 | Berry et al. | |
| 2,506,743 A | * | 5/1950 | Rose | 92/60 X |
| 2,658,484 A | | 11/1953 | Kenny | |
| 2,831,464 A | | 4/1958 | Lillquist | 92/52 X |
| 3,156,157 A | | 11/1964 | Smith et al. | |
| 3,209,542 A | * | 10/1965 | Francia | 92/85 B X |
| 3,869,861 A | * | 3/1975 | Case | 60/413 X |
| 4,000,756 A | | 1/1977 | Ule et al. | |
| 4,106,586 A | | 8/1978 | Stafford | |
| 4,186,649 A | | 2/1980 | Sundstrom | |
| 4,389,984 A | * | 6/1983 | Destrampe | 92/60 X |
| 4,450,928 A | | 5/1984 | Weber et al. | |
| 4,592,319 A | | 6/1986 | Meistrick | |
| 4,597,322 A | * | 7/1986 | Garnjost et al. | 92/60 X |
| 4,646,620 A | * | 3/1987 | Buchl | 92/13.1 X |
| 4,700,611 A | * | 10/1987 | Kaneko | 92/85 B X |
| 4,930,464 A | | 6/1990 | Letsche | |
| 5,058,614 A | | 10/1991 | Plohberger et al. | |
| 5,275,136 A | | 1/1994 | Schechter et al. | |

FOREIGN PATENT DOCUMENTS

| | | |
|---|---|---|
| DE | 3833-459 | 4/1990 |
| EP | 1 087 109 A3 | 3/2001 |
| EP | 1 087 109 A2 | 3/2001 |
| GB | 982003 | 6/1965 |
| JP | 59-180142 | 10/1984 |
| JP | 59229012 | 12/1984 |
| JP | 61-109905 | 5/1986 |
| WO | WO 90/14505 | 11/1990 |

OTHER PUBLICATIONS

U.S. patent application Ser. No. 09/742,199 for Variable Engine Valve Control System: filed Dec. 20, 2000, Lou, Z. (Attorney Docket No. 10541–27).
U.S. patent application Ser. No. 09/742,200 for Variable Engine Valve Control System: filed Dec. 20, 2000, Lou, Z. (Attorney Docket No. 10541–28).
European Search Report EP 02252690.9, Oct. 24, 2002.

*Primary Examiner*—Edward K. Look
*Assistant Examiner*—Michael Leslie
(74) *Attorney, Agent, or Firm*—Brinks Hofer Gilson & Lione (List continued on next page.)

(57) ABSTRACT

An actuator comprises a cylinder, a first, second and third port, an actuation piston, a control piston and a control spring. The cylinder defines a longitudinal axis and comprises a first and second end. The first port communicates with the first end of the cylinder, the second port communicates with the second end of the cylinder, and the third port communicates with the cylinder between the first and second ends. The actuation piston is disposed in the cylinder and is moveable along the longitudinal axis in a first and second direction. The actuation piston comprises a first and second side. The control piston also is disposed in the cylinder and is moveable along the longitudinal axis in a first and second direction. The control piston comprises a first and second side, with the first side of the control piston facing the second side of the actuation piston. The control spring biases the control piston in at least one of the first and second directions. A method of controlling the actuator is also provided.

43 Claims, 18 Drawing Sheets

U.S. PATENT DOCUMENTS 5,287,829 A 2/1994 Rose
5,410,947 A * 5/1995 Garnjost ..... 92/60 X
5,437,339 A * 8/1995 Tanaka ..... 92/85 R X
5,451,029 A 9/1995 Krüger
5,572,961 A 11/1996 Schechter et al.
5,603,305 A 2/1997 Miyake et al. ..... 123/568
5,713,315 A 2/1998 Jyoutaki et al.
6,085,501 A * 7/2000 Walch et al. ..... 92/63 X

* cited by examiner

PORT A2
Pexh
PORT C6
Pc
PORT E4
NOMINAL TOP-OF-CONTROL-PISTON POSITION
12
14
16
22
23
24
50
52
53
54
59
60
61
63
80
82
84
86

FIG. 14

| | RESTRICTED PORT E | RESTRICTED PORT C |
|---|---|---|
| BOTTOM CONTROL SPRING | • EMBODIMENT IN FIGURE 1<br>• Lev PROPORTIONAL TO Pc<br>• TWO PISTONS SEPARATE - LESS INERTIA<br>• Pc RETURN IF NO RETURN SPRING | • EMBODIMENT IN FIGURE 10<br>• Lev INVERSELY PROPORTIONAL TO Pc<br>• TWO PISTONS TOGETHER - MORE INERTIA<br>• CONTROL SPRING RETURN IF NO RETURN SPRING |
| MIDDLE CONTROL SPRING | • EMBODIMENT IN FIGURE 12<br>• Lev PROPORTIONAL TO Pc<br>• TWO PISTONS TOGETHER - MORE INERTIA<br>• Pc RETURN IF NO RETURN SPRING | • EMBODIMENT IN FIGURE 13<br>• Lev INVERSELY PROPORTIONAL TO Pc<br>• TWO PISTONS SEPARATE - LESS INERTIA<br>• CONTROL SPRING RETURN IF NO RETURN SPRING |

VARIABLE LIFT ACTUATOR

BACKGROUND

This invention relates generally to actuators and corresponding methods and systems for controlling such actuators, and in particular, to actuators providing independent lift and timing control.

In general, various systems can be used to actively control engine valves through the use of variable lift and/or variable timing so as to achieve various improvements in engine performance, fuel economy, reduced emissions, and other like aspects. Depending on the means of the control or the actuator, they can be classified as mechanical, electrohydraulic, electro-mechanical, etc. Depending on the extent of the control, they can be classified as variable valve-lift and timing (VVLT), variable valve-timing (VVT), and variable valve-lift (VVL).

Both lift and timing of the engine valves can be controlled by some mechanical systems. The lift and timing controls are generally, however, not independent, and the systems typically have only one-degree of freedom. Such systems are therefore not VVLT per se and are often more appropriately designated as variable valve-actuation (VVA) systems. Electro-mechanical VVT systems generally replace the cam in the mechanical VVLT system with an electro-mechanical actuator. However, such systems do not provide for variable lift.

In contrast, an electrohydraulic VVLT system is controlled by electrohydraulic valves, and can generally achieve independent timing and lift controls so as to thereby provide greater control capability and power density. However, typical electrohydraulic VVLT systems are generally rather complex, can be expensive to manufacture, and typically are not as reliable or robust as mechanical systems due to their relative complexity.

A true VVLT system has two degrees of freedom and offers the maximum flexibility to engine control strategy development. Typically, such systems require, for each engine valve or each pair of engine valves, at least two high-performance electrohydraulic flow control valves and a fast responding position sensing and control system, which can result in high costs and complexity.

For these reasons, typical control systems are not able to control engine valve lift and timing independently with a simple and cost effective design for mass production. Moreover, for non-hydraulic systems, it can be difficult to provide lash adjustment, which is to perform a longitudinal mechanical adjustment so that an engine valve is properly seated.

SUMMARY

Briefly stated, in one aspect of the invention, one preferred embodiment of an actuator comprises a cylinder, a first, second and third port, an actuation piston, a control piston and a control spring. The cylinder defines a longitudinal axis and comprises a first and second end. The first port communicates with the first end of the cylinder, the second port communicates with the second end of the cylinder, and the third port communicates with the cylinder between the first and second ends. The actuation piston is disposed in the cylinder and is moveable along the longitudinal axis in a first and second direction. The actuation piston comprises a first and second side. The control piston also is disposed in the cylinder and is moveable along the longitudinal axis in a first and second direction. The control piston comprises a first and second side, with the first side of the control piston facing the second side of the actuation piston. The control spring biases the control piston in at least one of the first and second directions.

In one preferred embodiment, a first chamber is formed between the first end of the cylinder and the first side of said actuation piston, a second chamber is formed between the second side of the control piston and the second end of the cylinder, a third chamber is formed between the second side of the actuation piston and the first side of the control piston. In alternative preferred embodiments, one of the second and third chambers forms an exhaust chamber, while the other of the second and third chambers forms a control chamber.

In one preferred embodiment, the first port is connected alternatively with a high pressure line and a low pressure exhaust line in a fluid supply assembly through an on/off valve when the valve is electrically energized and unenergized. The timing of the actuation is thus varied through the timing control of the on/off valve. One of the second and third ports, configured as a control port, is connected with a control pressure regulating assembly and thus under a control pressure. The other of the second and third ports, configured as an exhaust port, is connected with the exhaust line. In between the exhaust port and the exhaust chamber, there is a lift flow restrictor that exerts substantial resistance to flow through it. Because of the lift flow restrictor, pressure inside the exhaust chamber can be substantially different from that at the exhaust port under dynamic situations. As a result, the lift flow restrictor can make it difficult to move the control piston at a substantial speed. At its nominal position, the control piston is primarily balanced by the control pressure force and the control spring force. The nominal position of the control piston is thus regulated by the control pressure, and the position is not much or slowly changed under dynamic situations because of the lift flow restrictor.

In one preferred embodiment, the fluid actuator is applied to the control of the intake and exhaust valves of an internal combustion engine, wherein a piston rod, which is connected to the actuation piston, is connected to an engine valve stem. The engine valve is primarily pushed up or seated on a valve seat by a return spring and driven down, or opened, by the actuator.

In other aspects of the invention, methods of controlling the actuator are also provided.

The present invention provides significant advantages over other actuators and valve control systems, and methods for controlling actuators and/or valve engines. The incorporations of a second (control) piston, a control spring, a lift flow restrictor, and a control pressure port in an otherwise conventional single-piston-rod fluid actuator, provides a simple but robust actuator in which timing and lift can be independently controlled. In particular, the nominal position of the control piston is determined primarily by the force balance between the control pressure and the control spring. The stroke or lift of the actuation piston is determined by the position of the control piston. Even when being pushed by the actuation piston, the control piston is able to stay, for a short but sufficient period of time, substantially at its nominal position.

In addition, although the actuation time for a typical engine valve is very fast and is in the range of a few milliseconds, that fast time response is not required to change the lift of the valve. Rather, the actuators of the present invention use a simple control piston/control spring mechanism to achieve the lift control. The control pressure for all actuators of the intake valves or exhaust valves or both of an entire internal combustion engine can be regulated by a single pressure regulator, the cost of which is thus spread over the entire engine. Only a simple switch valve per fluid actuator is needed to control the actuation. There is no need for sophisticated position sensing and control.

In addition, in conventional systems, in order to achieve a closed loop position feedback control during a short period of time, super fast hydraulic switch valves are needed. With the open loop approach of the present invention, the hydraulic switch valves are not required to have a super fast time response.

The present invention, together with further objects and advantages, will be best understood by reference to the following detailed description taken in conjunction with the accompanying drawings.

BRIEF DESCRIPTION OF THE DRAWINGS

FIG. 14 is a table listing features of four preferred embodiments with different positioning of the control spring and the flow restrictor.

DETAILED DESCRIPTION OF THE PRESENTLY PREFERRED EMBODIMENTS

Figure 1:
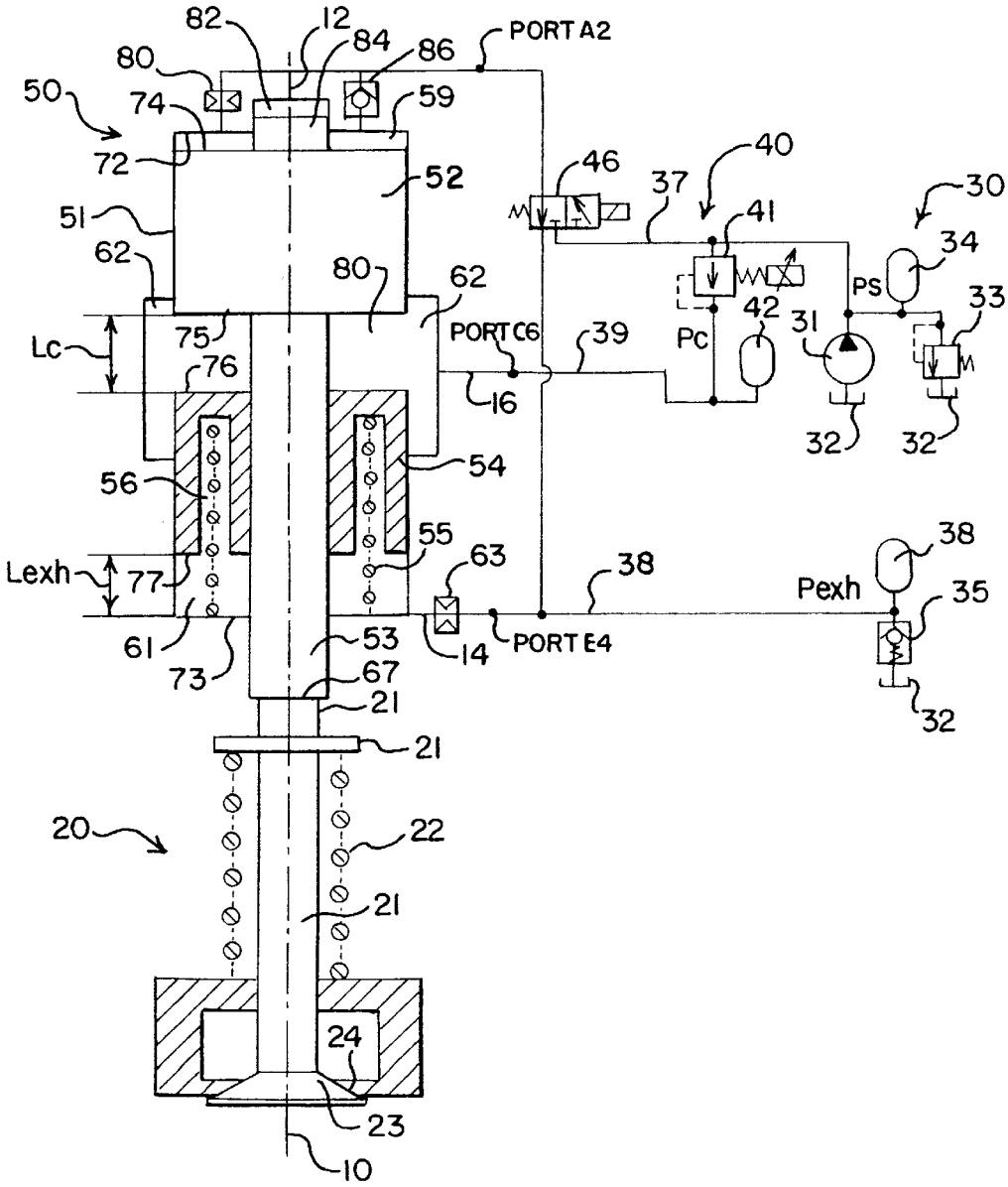
FIG. 1 is a schematic illustration of one preferred embodiment of the actuator and hydraulic supply system.

Referring now to FIG. 1, a preferred embodiment of the invention provides an engine valve lift and timing control system using a hydraulic cylinder, two pistons, and an unrestricted control port being connected with the fluid chamber between the two pistons. The system consists of an engine valve 20, a hydraulic actuator 50, a hydraulic supply assembly 30, a control pressure regulating assembly 40, and an on/off valve 46.

The hydraulic supply assembly 30 includes a hydraulic pump 31, a system pressure regulating valve 33, a system-pressure accumulator or reservoir 34, an exhaust-pressure valve 35, an exhaust-pressure accumulator or reservoir 36, an fluid tank 32, a supply line 37, and an exhaust line 38. The hydraulic supply assembly 30 provides necessary hydraulic flow at a system pressure Ps and accommodates exhaust flows at an exhaust pressure Pexh. The hydraulic pump 31 pumps hydraulic fluid from the fluid tank 32 to the rest of the system through the supply line 37. The system pressure Ps is regulated through the system pressure regulating valve 33. The system-pressure accumulator 34 is an optional device that helps smooth out system pressure and flow fluctuation. The hydraulic pump 31 can be of a variable-displacement type to save energy. The system pressure regulating valve 33 may be replaced by an electrohydraulic pressure regulator (not shown) to vary the system pressure Ps if necessary. The system-pressure accumulator 34 may be eliminated if the total system has a proper flow balance and/or sufficient built-in capacity and compliance. The exhaust line 38 takes all exhaust flows back to the fluid tank 32 through the exhaust-pressure valve 35. The exhaust pressure valve 35 is to maintain a designed or minimum value of the exhaust pressure Pexh. The exhaust pressure Pexh is elevated above the atmosphere pressure to facilitate back-filling without cavitation and/or over-retardation. The exhaust pressure valve 35 can be simply of a spring-loaded check valve type as shown in FIG. 1 or of an electrohydraulic type for variable control if so desired. The exhaust-pressure accumulator 36 is an optional device that helps smooth out system pressure and flow fluctuation.

The control pressure regulating assembly 40 includes an electrohydraulic pressure regulator 41 and an optional control-pressure accumulator or reservoir 42 to provide a variable control pressure Pc in a control line 39. The control-pressure accumulator 42 may be eliminated if this sub-circuit has a proper flow balance and/or sufficient built-in capacity and compliance.

The on/off valve 46 provides to its load either the system pressure Ps or the exhaust pressure Pexh. The valve 46 shown in FIG. 1 is a normally-off 3-way 2-position on/off solenoid valve. The phrase normally-off means that the valve output is switched to the exhaust pressure Pexh when the solenoid of the on/off valve 46 is not electrically energized. Because the load in this case does not need a high pressure flow most of the time, a normally-off valve saves the electrical energy need by its solenoid. One can use one of many other kinds of electrohydraulic or solenoid valves to achieve the same on/off switch function.

The engine valve 20 includes an engine valve head 23 and an engine valve stem 21. The engine valve 20 interfaces with the hydraulic actuator 50 through the engine valve stem 21. The engine valve 20 moves along its axis. The engine valve 20 as shown in FIG. 1 is pushed up by a return spring 22 and driven down by the hydraulic actuator 50. When fully returned, the engine valve head 23 is in contact with and seals off an engine valve seat 24, which can be either for intake or exhaust.

The hydraulic actuator 50 includes a hydraulic cylinder 51 having a longitudinal axis 10 and comprising three ports communicating therewith: a first, actuation port 2 or port A, a second exhaust port 4 or port E, and a third control port 6 or port C. The term "longitudinal" as used herein means of or relating to length or the lengthwise dimension and/or direction. Within the hydraulic cylinder 51 and along its axis, there is an actuation piston 52, a control piston 54, a piston rod or stem 53, and a control spring 55. Each of the actuation and control pistons 52, 54 have a first and second side 74, 75, 76, 77, respectively. The second side 75 of the actuation piston 52 is connected to the top of the piston rod 53. The piston rod and actuation piston can be integrally formed as a single part, or can be mechanically connected with fasteners and the like or by welding. The actuation piston 52 and the control piston 54 are disposed co-axially within the upper and lower parts of the cylinder 51, respectively and move in a first and second direction along the axis 10. Although depicted as having the same diameter in FIG. 1, the two pistons 52 and 54 may have two different nominal diameter values if so desired.

As shown in FIGS. 1, the control piston 54 has a ring shape with its inner cylindrical surface co-axially mating with and sliding along the piston rod 53 and with its outer surface co-axially mating with and sliding inside the hydraulic cylinder 51. In alternative embodiments, shown in FIGS. 17A–19, the piston rod 53 is connected to the first side 74 of the actuation piston and extends through the first end 72 of the cylinder. Referring again to FIG. 1, the two pistons 52 and 54 divide the hydraulic cylinder 51 into three chambers: an actuation chamber 59, a control chamber 60, and an exhaust chamber 61, which communicate with the outside hydraulic circuits through port A, port C, and port E, respectively. There should be negligible internal leakages among the three chambers 59, 60 and 61. Through an annular undercut 62 in the middle section of the hydraulic cylinder 51, free hydraulic connection or passage between the control chamber 60 and port C is guaranteed for all possible operation modes or positions of the pistons 52 and 54. At the same time, the undercut 62 does not compromise a proper hydraulic separation or isolation among the three chambers 59, 60 and 61. A control spring 55 is disposed inside the exhaust chamber 61 and immediately below the control piston 54 in a biasing relationship with the second side 77 thereof.

The actuation piston 52 has at its top end a cushion protrusion 84 which, when near or at the top position, mates with a cushion cavity 82 at the top end of the hydraulic cylinder 51 and blocks the direct wide-open hydraulic connection, or the primary fluid flow passageway 12 between the actuation chamber 59 and port A. As an alternative, or in combination therewith, hydraulic fluid travels through a pair of secondary fluid flow passageways, with one secondary passageway having a substantially restrictive cushion flow restrictor 80 and the other a cushion check valve 86, which allows only one-directional flow from port A to the actuation chamber 59, not the other way around. In this way a plurality, meaning more than one, of fluid passageways communicate between port A 2 and the actuation chamber.

Port A 2 is hydraulically connected with the on/off valve 46. In the embodiment shown in FIG. 1, the on/off valve 46 switches port A and thus the chamber 59 to the system pressure Ps and the exhaust pressure Pexh respectively when it is electrically energized and unenergized, respectively. Port C and the control chamber 60 are hydraulically connected with a fluid flow passageway 16, and are further connected with the control pressure regulating assembly 40, and they are thus under the control pressure Pc.

Port E 4 is hydraulically connected with the exhaust line 38 and is under the exhaust pressure Pexh. In between port E 4 and the exhaust chamber 61, which are connected with a fluid flow passageway 14, there is a lift flow restrictor 63 that exerts substantial resistance to flow through port E. Because of the lift flow restrictor 63, pressure inside the exhaust chamber 61 can be substantially different from the exhaust pressure Pexh under dynamic situations. Also because of the lift flow restrictor 63, it is difficult to move the control piston 54 at a substantial speed. Hydraulic flow restriction devices or orifices are of two general types. An orifice with a large ratio of length over diameter and round edges tends to promote laminar flow, and its flow resistance characteristics are strongly sensitive to viscosity and thus fluid temperature. A short orifice with sharp edges tends to promote turbulent flow, and its flow resistance characteristics are substantially less sensitive to viscosity and thus fluid temperature.

At its nominal position and when not in direct contact with either the cylinder bottom end surface 73 or the actuation piston bottom end surface 75, the control piston 54 is primarily balanced in the axial direction by hydraulic force due to the control pressure Pc at the control piston top end surface 76 and force from the control spring 55 at the control piston bottom end surface 77. To a lesser extent and at its bottom end surface 77, the control piston 54 is also under the exhaust pressure Pexh, which is normally lower than the control pressure Pc. For a given spring design and a given value of the exhaust pressure Pexh, the nominal position of the control piston 54 along its axis is thus determined by the control pressure Pc, and the position is not much or slowly changed under dynamic situations because of the lift flow restrictor 63.

The piston rod 53 and the engine valve stem 21 transfer forces and motion to each other. They can be either free-floating or mechanically tied together if necessary. When free-floating, they maintain the mechanical contact on the ends 67 at all operating conditions through a properly designed combination of the upward force of the return spring 22 and hydraulic pressure forces at the actuation piston 52.

The lash adjustment for the engine valve 20 is achieved by making sure that the axial distance from the engine valve head 23 to the top surface 74 of the actuation piston 52 is less than the axial distance from the engine valve seat 24 to the cylinder top end surface 72. In another word, there is still a certain amount of travel distance in the actuation chamber 59 when the engine valve 20 is seated.

Figure 18:
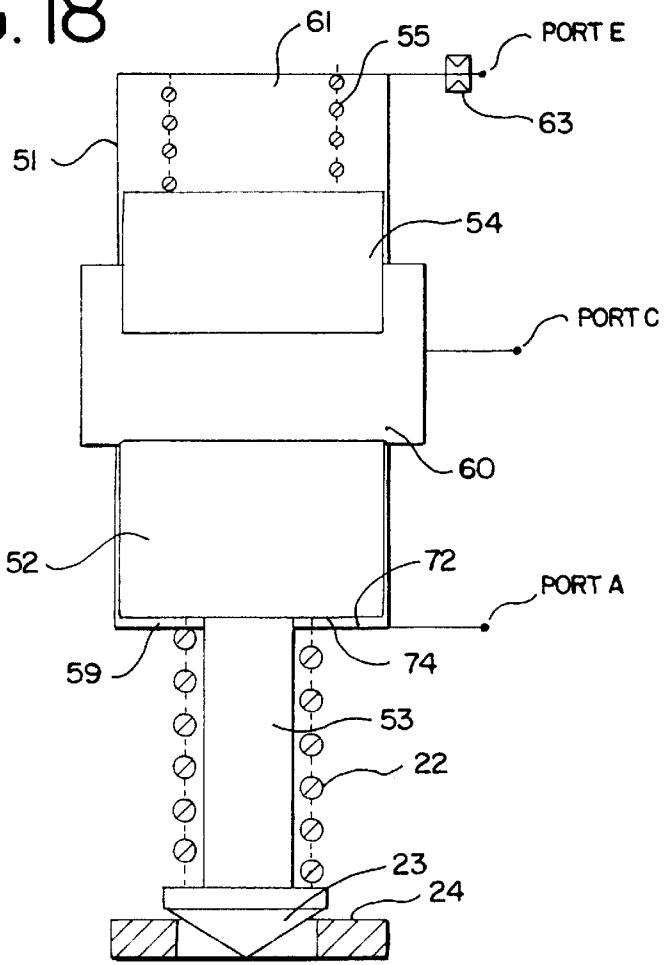
FIG. 18 is a schematic illustration of an alternative embodiment of the actuator with a piston rod connected to a first side of an actuation piston and a valve seated on a valve seat.

In one alternative embodiment, shown in FIG. 18, the face of the valve head 23, rather than its back side, is seated on a valve seat. In this embodiment, the return spring 22 biases the valve head 23 into a normally closed or seated position. In another alternative embodiment, shown in FIG. 19, the valve head 23 is positioned in a normally open or unseated position, as it is biased by the return spring 22. In this embodiment, the actuator is actuated to close the valve, rather than open it.

Figure 5:
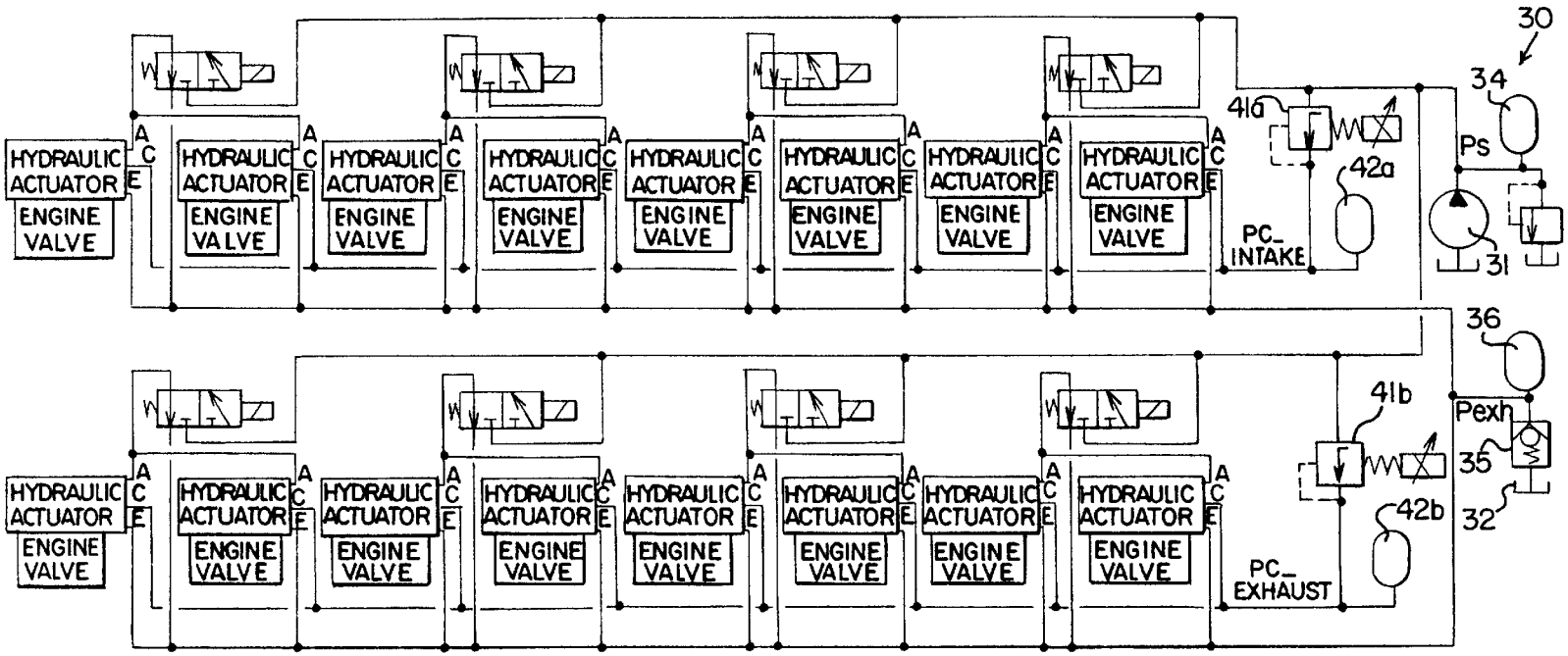
FIG. 5 is a schematic illustration of one preferred system for a 16-valve 4-cylinder engine.

In general, and referring again to FIG. 1, there is one hydraulic actuator 50 for each engine valve 20. For an engine cylinder with two intake engine valves and two exhaust valves (not shown), one needs only two on/off valves, with one of them feeding the pair of intake engine valves and another feeding the pair of the exhaust engine valves. If there is a need for independent intake and exhaust lift controls, the whole engine then needs two separate control pressure regulating assemblies 40. However, one set of hydraulic supply assembly 30 supplying one system pressure Ps should be sufficient. If necessary, one can also size the hydraulic actuator 30 differently for intake and exhaust engine valve applications. For a fully-controlled 16-valve 4-cylinder engine, a preferred system arrangement is illustrated in FIG. 5. The system consists of one hydraulic supply assembly 30, two control pressure regulating assemblies 40, eight on/off valves 46, and 16 hydraulic actuators 50. If either only intake or exhaust engine valves are to be controlled, the system then consists of one hydraulic supply assembly 30, one control pressure regulating assembly 40, four on/off valves 46, and eight hydraulic actuators 50. In some cases, one hydraulic actuators may drive two intake or two exhaust valves on a single engine combustion cylinder.

During operation, the hydraulic pump 31 as shown in FIG. 1 pumps hydraulic fluid from the fluid tank 32 to the supply line 37. With the help from the optional system-pressure accumulator 34, the system pressure regulating valve 33 is to make sure that supply line 37 is at the system pressure Ps. Any excess fluid in the supply line 37 is either bled back to the fluid tank 32 through the system pressure regulating valve 33 or stored temporarily in the system-pressure accumulator 34.

With the help from the optional control pressure accumulator 42, the electrohydraulic pressure regulator 41 diverts a certain amount of fluid from the supply line 37 to the control line 39, with the fluid pressure being reduced from the system pressure Ps to the control pressure Pc, the value of which is determined by a controller (not shown) based on the real time engine valve lift need. Fluid under the control pressure Pc is sent to port C.

The on/off valve 46 as shown in FIG. 1 is of a normally-off type. When being electrically energized and unenergized, it connects port A to the supply line 37 and the exhaust line 38, respectively.

With the help from the optional exhaust-pressure accumulator 36, the exhaust-pressure valve 35 maintains the fluid in the exhaust line 38 at the exhaust pressure Pexh before the fluid is returned to the fluid tank 32. The exhaust line 38 is also connected to port E 4.

Figure 2B:
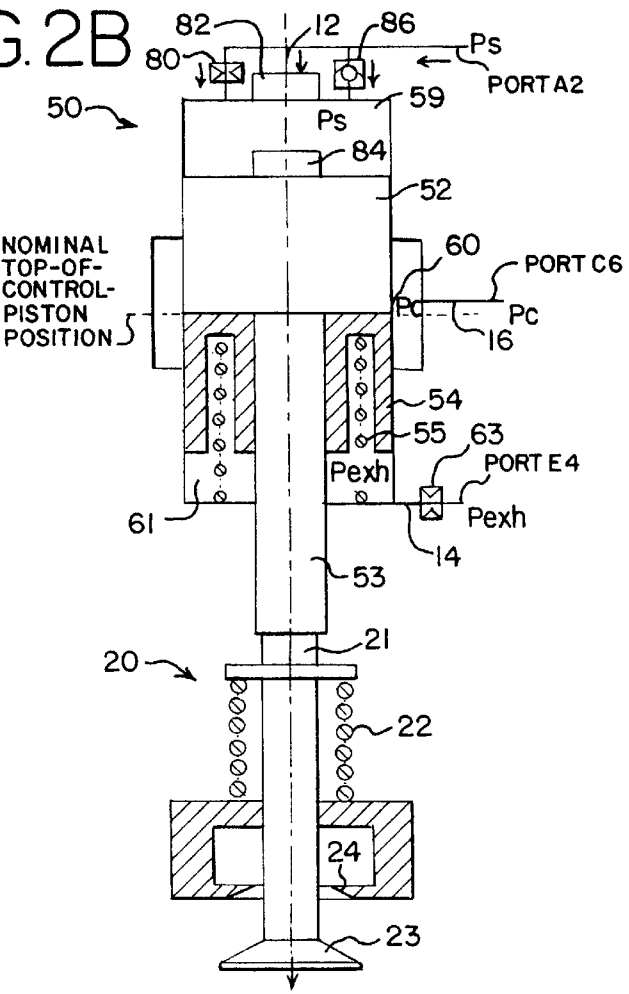
FIGS. 2A, 2B, 2C, 2D, 2E, 2F, and 2G are schematic illustrations of various stages A, B, C, D, E, F, and G of a valve stroke. These stages are also marked in FIG. 3. For simplicity in illustration, the drawings do not include the hydraulic supply system.

FIG. 2 depicts various operation stages or states A, B, C, D, E, and F of the hydraulic actuator 50 and the engine valve 20 and, for simplicity in illustration, does not include the rest of the hydraulic circuit. At all these operation states, the control pressure Pc is set, for the ease of explanation, at one constant value that places the control piston 54 at one nominal or resting position shown in FIG. 2A. The actual position of the control piston 54 deviates somewhat from this nominal position during certain periods of an actuation cycle, which will be explained shortly. The control pressure Pc is always higher than the exhaust pressure Pexh because of the need to balance the force from the control spring 55. As illustrated in FIG. 3, and in particular the line designated as "engine valve opening," states A, B, C, D, E, and F are, respectively, the beginning of the opening stroke, the end of the opening stroke, the middle of the dwell period, the beginning of the closing stroke, the middle of the closing stroke, and near the end of the closing stroke of the engine valve 20. FIG. 3 also illustrates the pressures in the actuation chamber, the control chamber and the exhaust chamber at the various states.

Figure 2A:
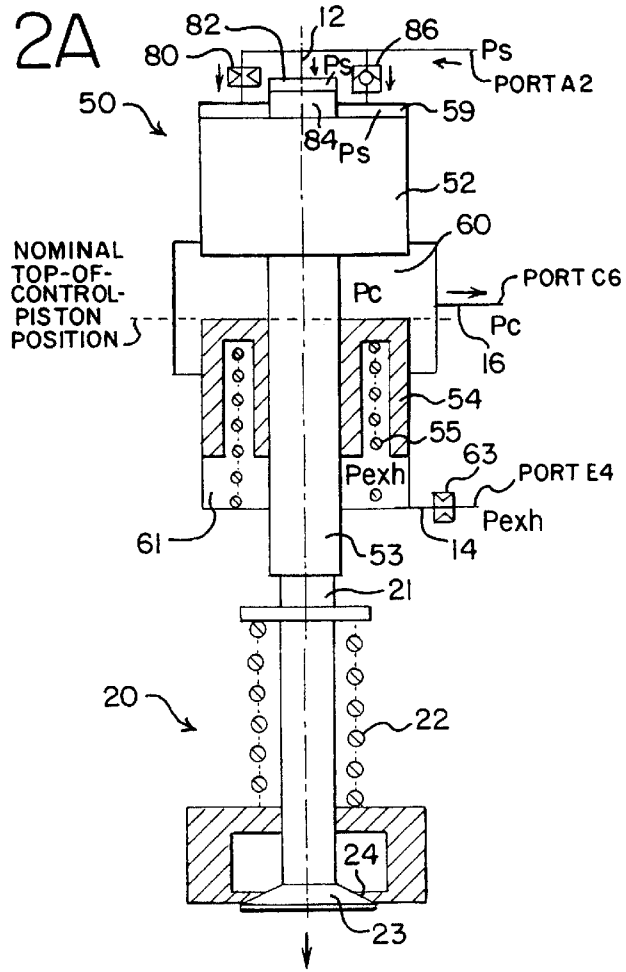
Figure 3:
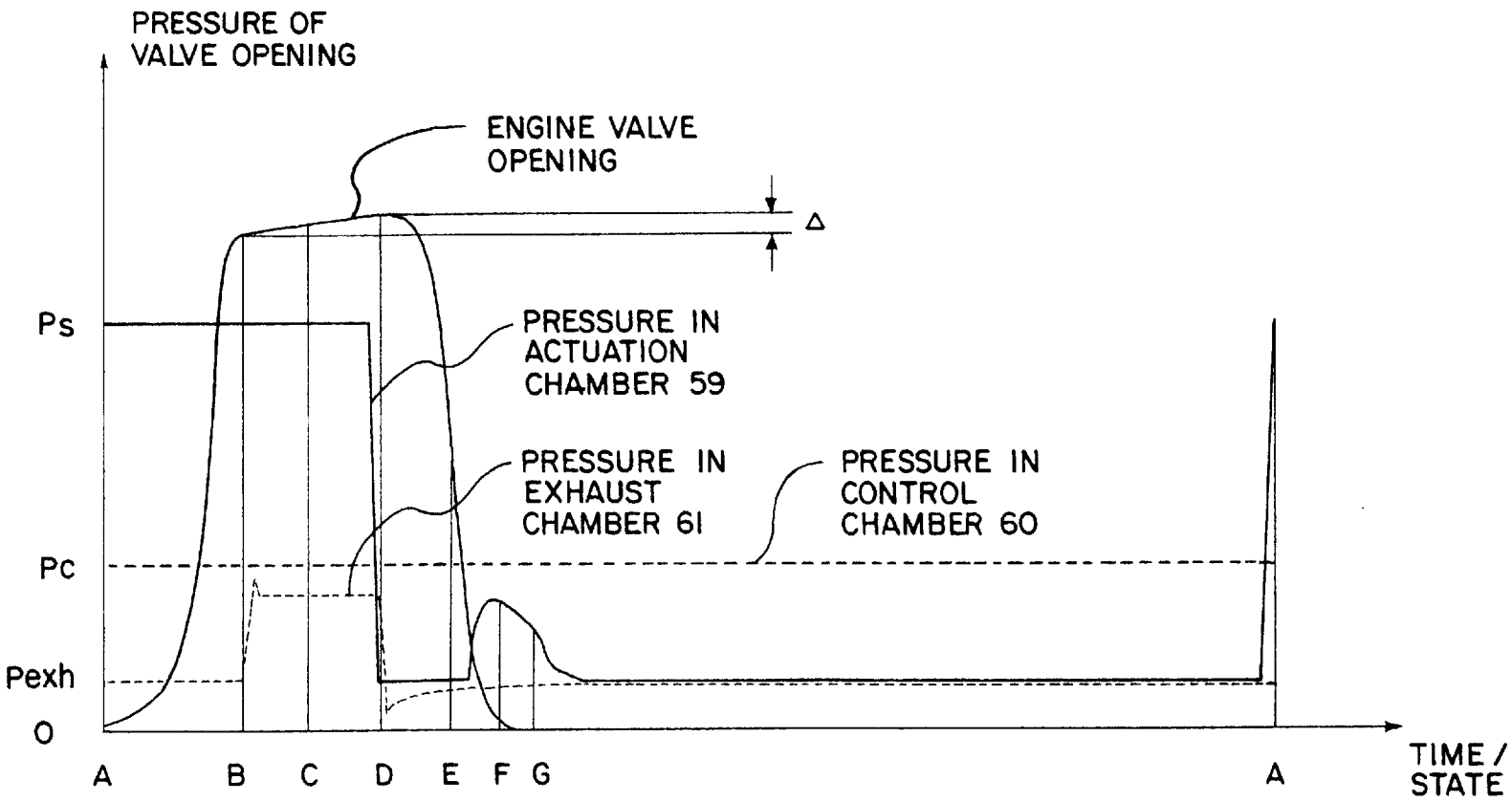
FIG. 3 is a graphical illustration of the time histories of the engine valve movement and pressure variations inside various chambers for the embodiment shown in FIG. 1.

At state A or the beginning of the opening stroke shown in FIG. 2A, port A is just connected to the system pressure Ps. The cushion cavity 82 is directly connected with port A, and its pressure is substantially equal to the system pressure Ps. The pressure in the actuation chamber 59 is actually slightly below the system pressure Ps because of the pressure losses through the cushion flow restrictor 80 and the cushion check valve 86. This pressure drop is not substantial because of the presence of the cushion check valve 86, which accommodates most of the flow from port A to the actuation chamber 59. The actuation piston 52 starts pushing the engine valve 20 downward, or in a first direction, although there is no detectable displacement yet. It should be understood that the cylinder and pistons can be oriented in any direction, and the vertical orientation, with the engine valve moving downward is meant to be illustrative rather than limiting. The system pressure Ps is substantially higher than the control pressure Pc because of the need for the actuation piston 52 to overcome the force from the return spring 22 and the engine cylinder pressure force and the need to open the engine valve 20 within a very short period of time. The control chamber 60 and the exhaust chamber 61 are under the control pressure Pc and the exhaust pressure Pexh, respectively. The control piston 54 stays at its nominal position.

At state B or the end of the opening stroke shown in FIG. 2B, port A is at the system pressure Ps. The pressure in the actuation chamber 59 is only slightly below the system pressure Ps, with flow coming through, in order of magnitude, the cushion cavity 82, the cushion check valve 86, and the cushion flow restrictor 80. The actuation piston 52 has traveled in the first direction through the free space allowed by the control piston 54 and is now in contact with the control piston 54. As a result, the engine valve 20 has also traveled through its entire lift.

State B is also the beginning of the dwell period, during which the engine valve 20 is kept open. In the dwell period, the actuation piston 52 tries to move down further under the system pressure Ps and has to move with the control piston 54. Because of the lift flow restrictor 63 and the fluid bulk modulus, the control piston 54 has hard time displacing fluid in the exhaust chamber 61 during a short period of time. During the dwell period as shown in FIG. 2C, the pressure in the exhaust chamber 61 rises above the exhaust pressure Pexh and to a level that is sufficient to help substantially slow the downward movement of the control piston 54, the actuation piston 52, and the engine valve 20. This restriction is not absolute. Even within a very short period of dwell time, the fluid volume in exhaust chamber 61 will be reduced because of a certain amount of leakage through the lift flow restrictor 63 and the volume compression due to rising pressure. At state D (the end of the dwell period or the beginning of the closing stroke) shown in FIG. 2D, the position of the control piston 54 is somewhat lower than its nominal position. This translates into a further opening (Δ) of the engine valve 20 during the dwell period as shown in FIG. 3.

Figure 2D:
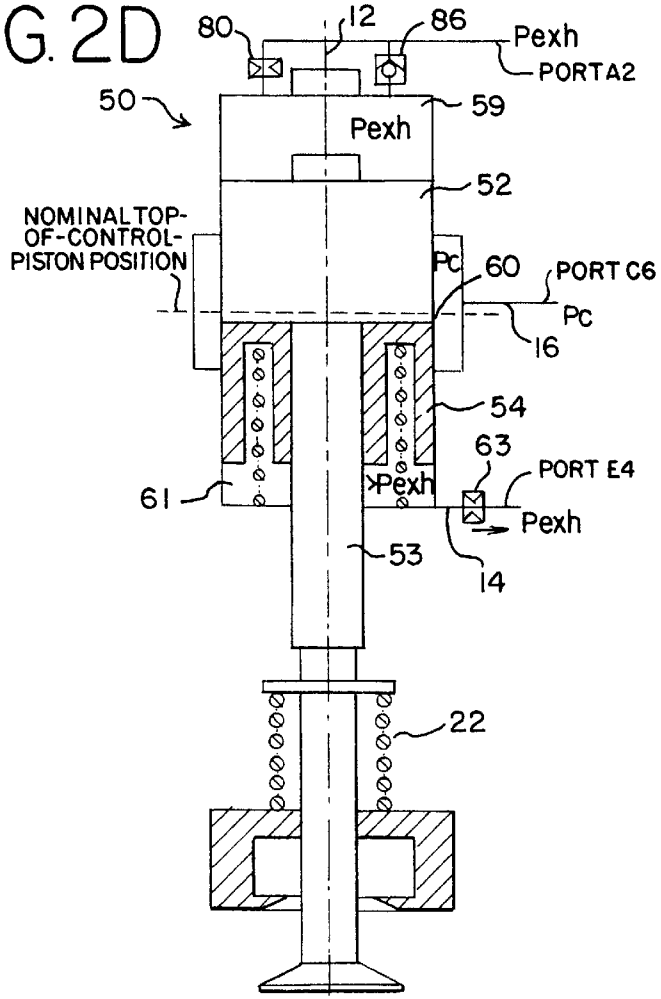
Figure 2C:
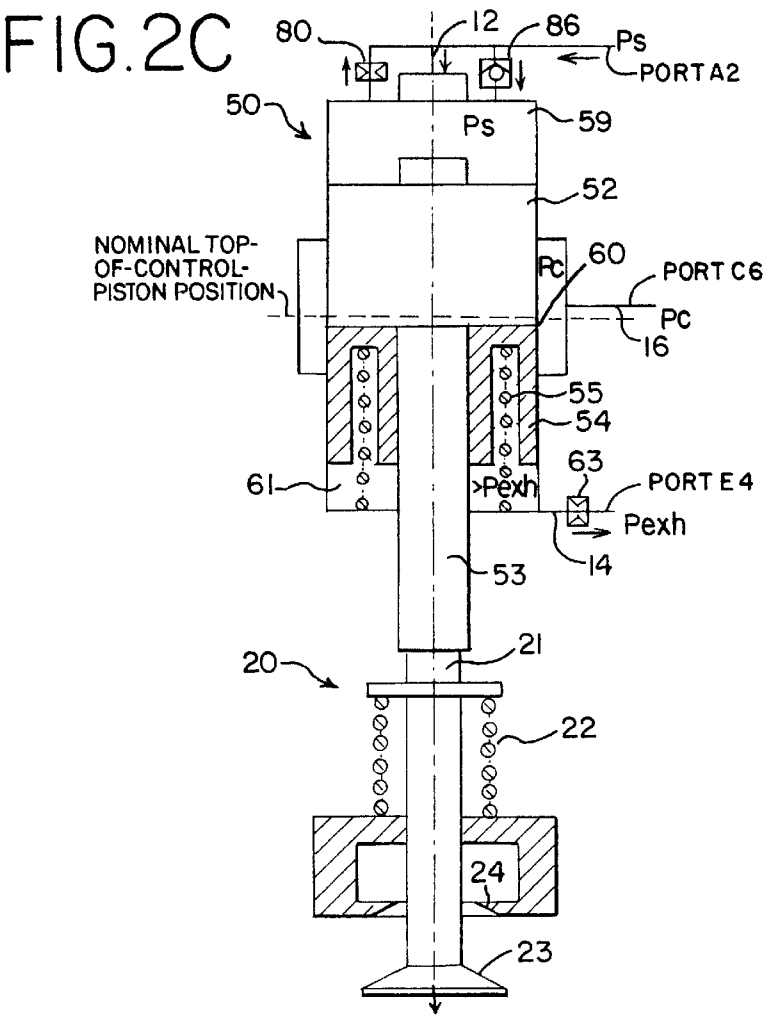

At state D (the beginning of the closing stroke) shown in FIG. 2D, port A and thus the actuation chamber 59 are switched from the system pressure Ps to the exhaust pressure Pexh. There is still a small flow out of the exhaust chamber 61 through the lift flow restrictor because of an excess pressure in the exhaust chamber 61 relative the exhaust pressure Pexh. The engine valve motion is substantially equal to zero at this point in time, right in the transition from the dwell period to the closing stroke.

Figures 2E, 2F, 2G:
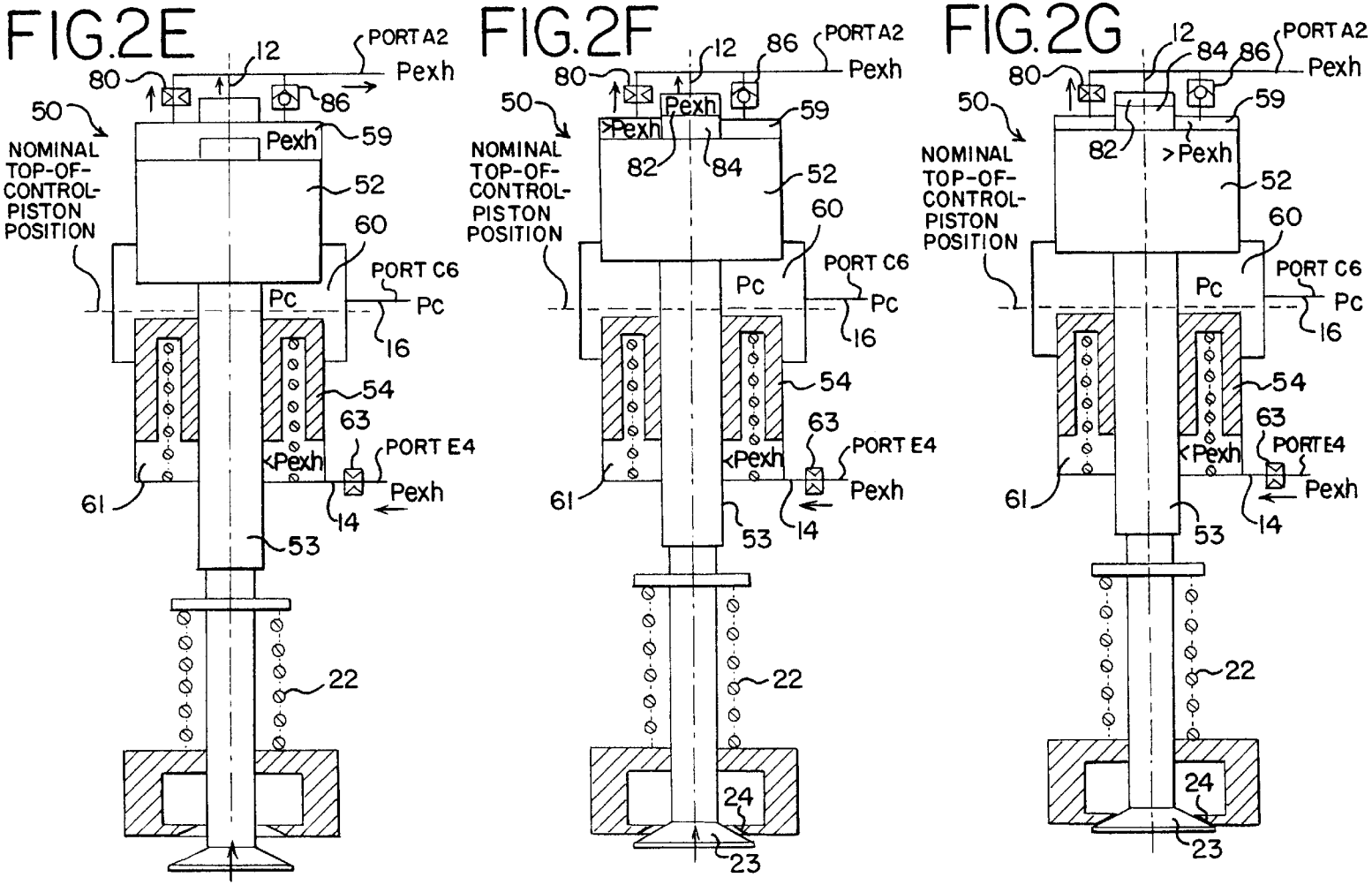

During the middle of the closing stroke as shown in FIG. 2E, the engine valve 20 and thus the actuation piston 52 are being pushed back in a second direction opposite the first direction, primarily by the return spring 22. The control pressure Pc at the bottom of actuation piston 52 helps too. Because of the loss of the contact force from the actuation piston 60, the control piston 54 is to return to its nominal position, which is hampered by slow back-filling of the exhaust chamber 61 through the lift flow restrictor 63. As a result, the pressure inside the exhaust chamber 61 is somewhat lower than the exhaust pressure Pexh.

For a long, reliable operation, it is essential to have a soft landing, that is to have a substantially low velocity when the engine valve head 23 touches the engine valve seat 24. Near the end of the closing stroke as shown in FIG. 2F, the cushion protrusion 84 slides into the cushion cavity 82 and blocks off the direct flow escape route from the actuation chamber 59 to port A through the cushion cavity 82. With the directionality of the cushion check valve 86, the fluid in the actuation chamber 59 can exit only through the highly resistive cushion flow restrictor 80, resulting in a quick pressure rise in the actuation chamber 59 as shown in FIG. 3 which in turn substantially slow down the velocity of the actuation piston 52 and engine valve 20 assembly.

At state D (the end of the closing stroke) shown in FIG. 2G, the engine valve 22 is back to the closed position again. The control piston 54 is probably still on its way to its nominal position, which is slowed by the retarded backfilling of the exhaust chamber 61 through the lift flow restrictor 63.

Figure 4:
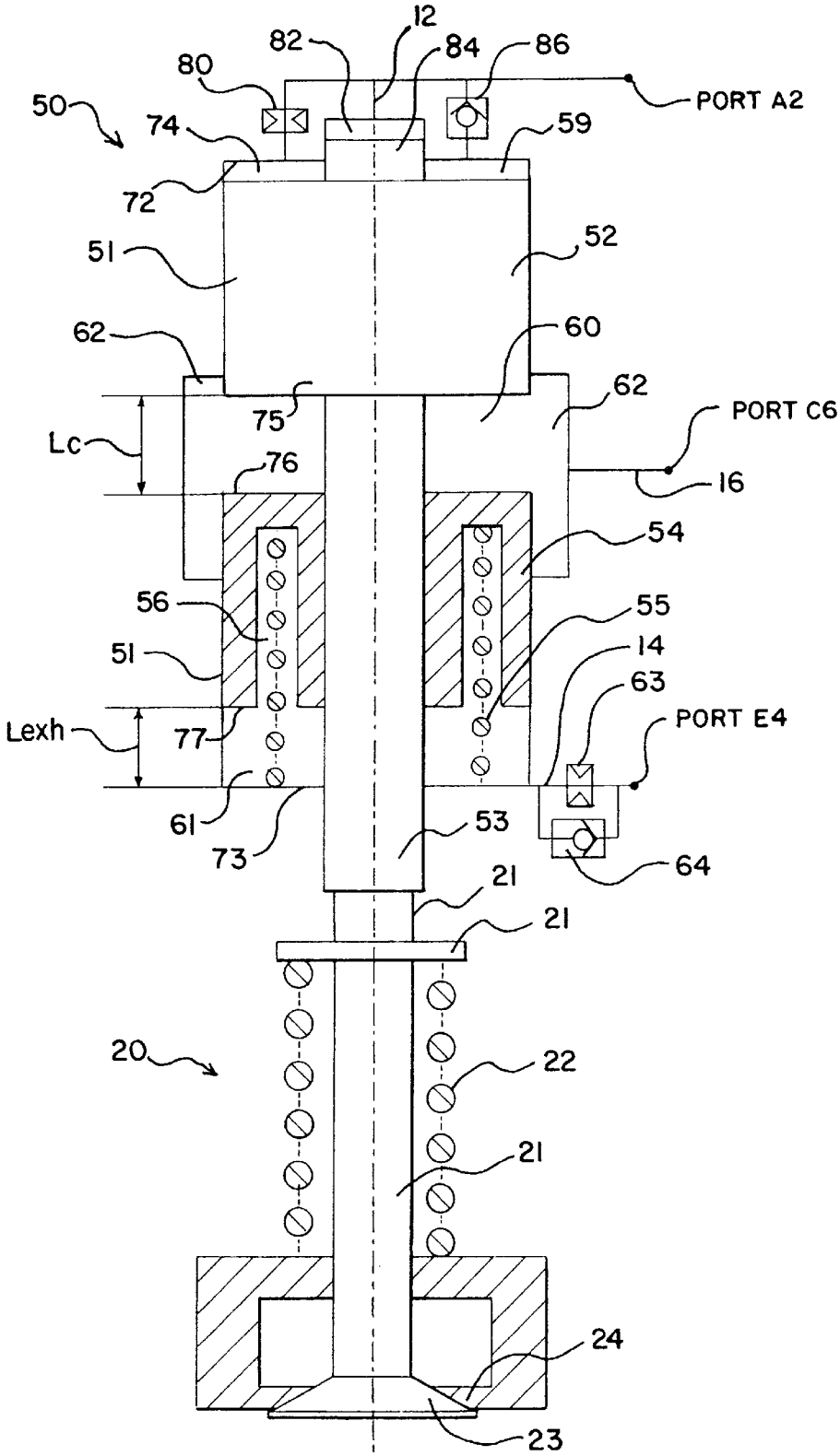
FIG. 4 is a schematic illustration of an alternative embodiment of the actuator having an alternative flow restriction device at the exhaust port or Port E.

During the closed period, which is between state G of the current engine valve cycle and state A of the next engine valve cycle, the actuation chamber 59 remains to be connected to the exhaust pressure Pexh. This period should be long enough for the control piston 54 to move back to its nominal position. If necessary as shown in FIG. 4, a check valve 64 can be added in parallel with the lift flow restrictor 63 to assist a fast backfilling of the exhaust chamber 61.

Figure 6:
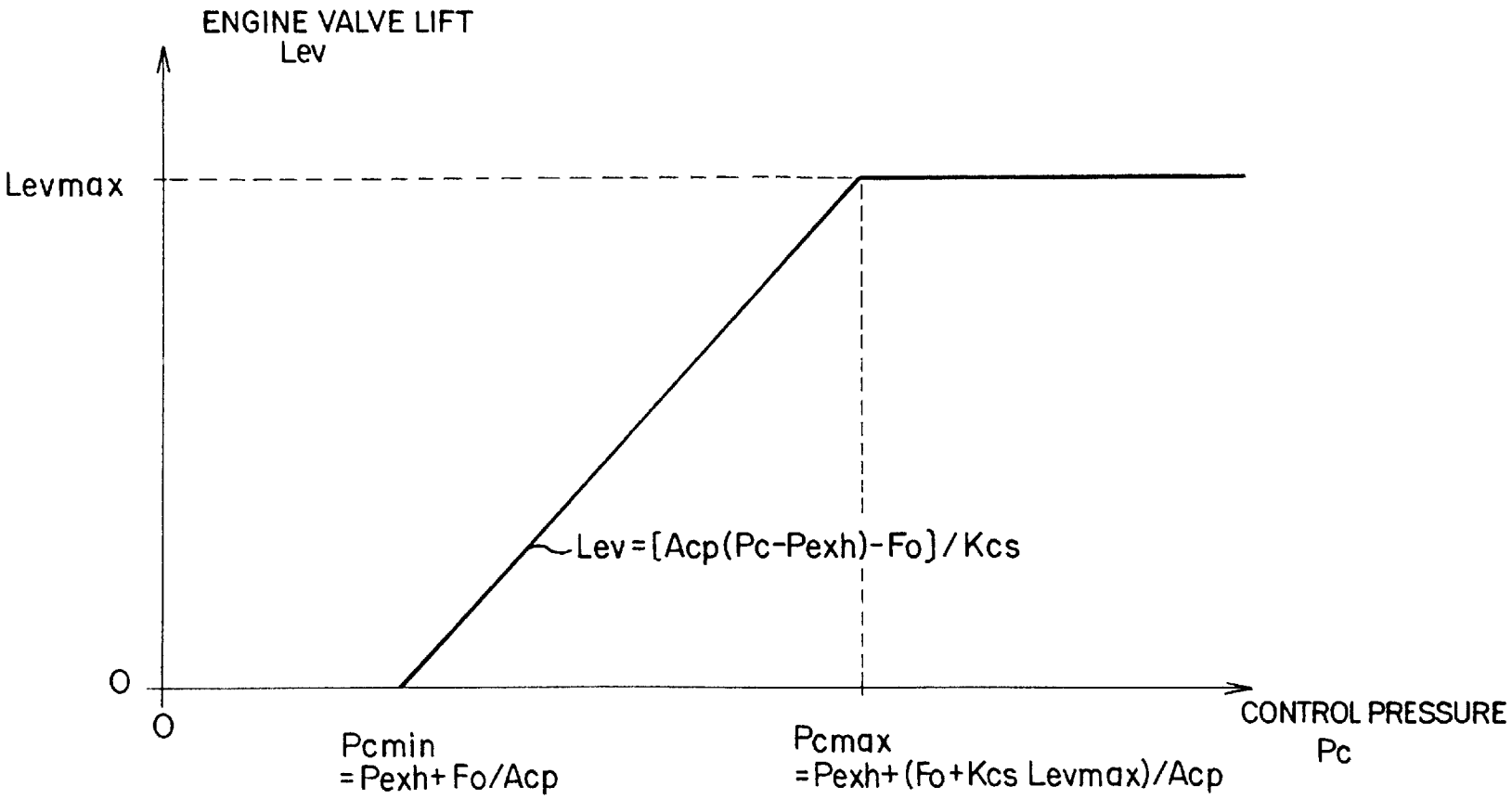
FIG. 6 is a graph illustrating the relationship between engine valve lift Lev and control pressure Pc for the embodiments shown in FIGS. 1 and 12.
Figure 7:
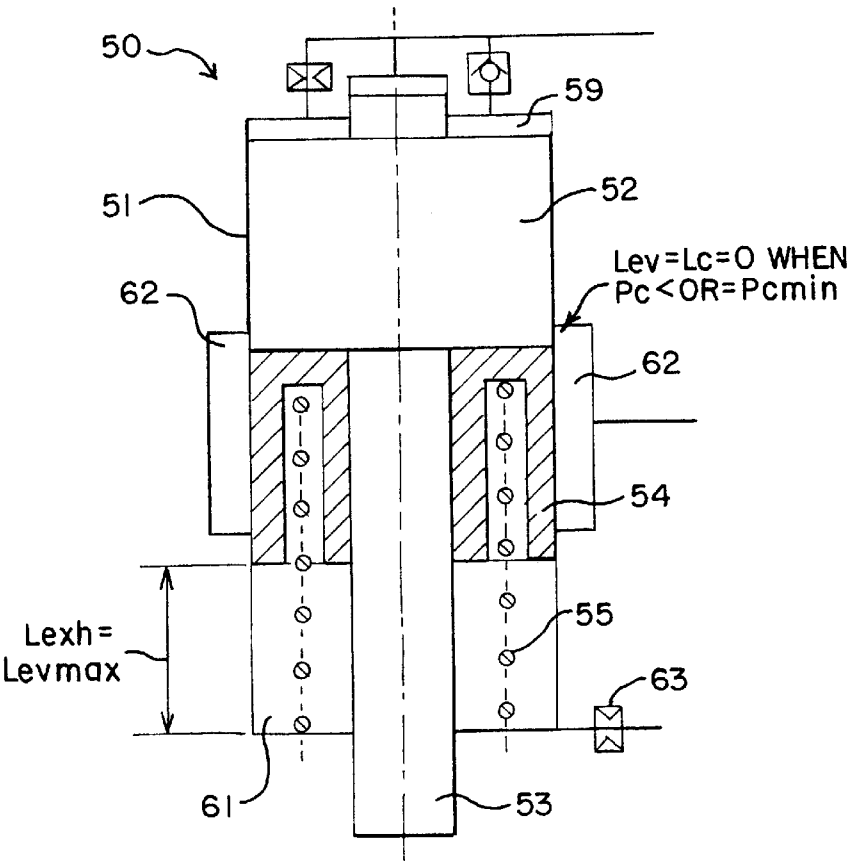
FIG. 7 is a schematic illustration of an actuator with zero engine valve lift as $Pc \leqq Pc$ min.

The nominal position of the control piston 54 depicted in FIGS. 1 and 2 is roughly in the middle of the available range. The engine valve lift is equal to the control chamber height Lc when the actuation piston 52 is retracted to the rest position as shown in FIG. 1. The nominal position of the control piston 54 and thus the engine valve lift are controlled by the control pressure Pc. If the control spring 55 is linear, the engine valve lift Lev will be proportional to the control pressure Pc within its control range as shown in FIG. 6. Let Fo and Kcs be the preload and spring stiffness of the control spring 55. Let Acp be the cross section area of the control piston 54. The threshold Pcmin for the control pressure Pc to start moving the control piston 54 away from the actuation piston 52 is equal to the exhaust pressure Pexh plus the preload of the control spring 55 divided by the cross-section area of the control piston 54, i.e., Pc min=Pexh+Fo/Acp. When Pc≦Pc min, the engine valve lift Lev is zero as shown in FIG. 7.

Figure 8:
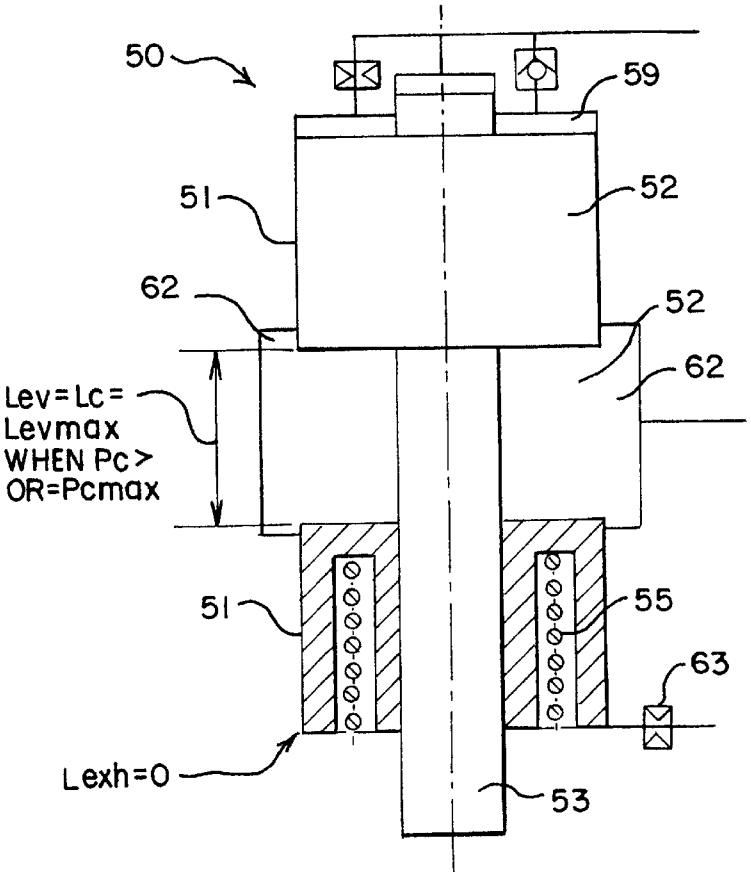
FIG. 8 is a schematic illustration of an actuator with maximum engine valve lift (Lev max) as $Pc \geqq Pc$ max.

As shown if FIG. 8, beyond the maximum engine lift Lev max, the control piston 54 is stuck at the bottom of the hydraulic cylinder 51 and can not travel down farther even with a higher control pressure Pc. If Pc max is this saturation pressure for the control pressure Pc, then Pc max=Pexh+(Fo+Kcs Lev max)/Acp. Between Pc min and Pc max, the engine valve lift Lev is proportional to the control pressure Pc in the following manner: Lev=(Acp(Pc−Pexh)−Fo)/Kcs. It should be understood that the piston rod 53 shown in FIGS. 7 and 8 can be connected to an engine valve, which has been omitted for the sake of simplicity.

Figure 9:
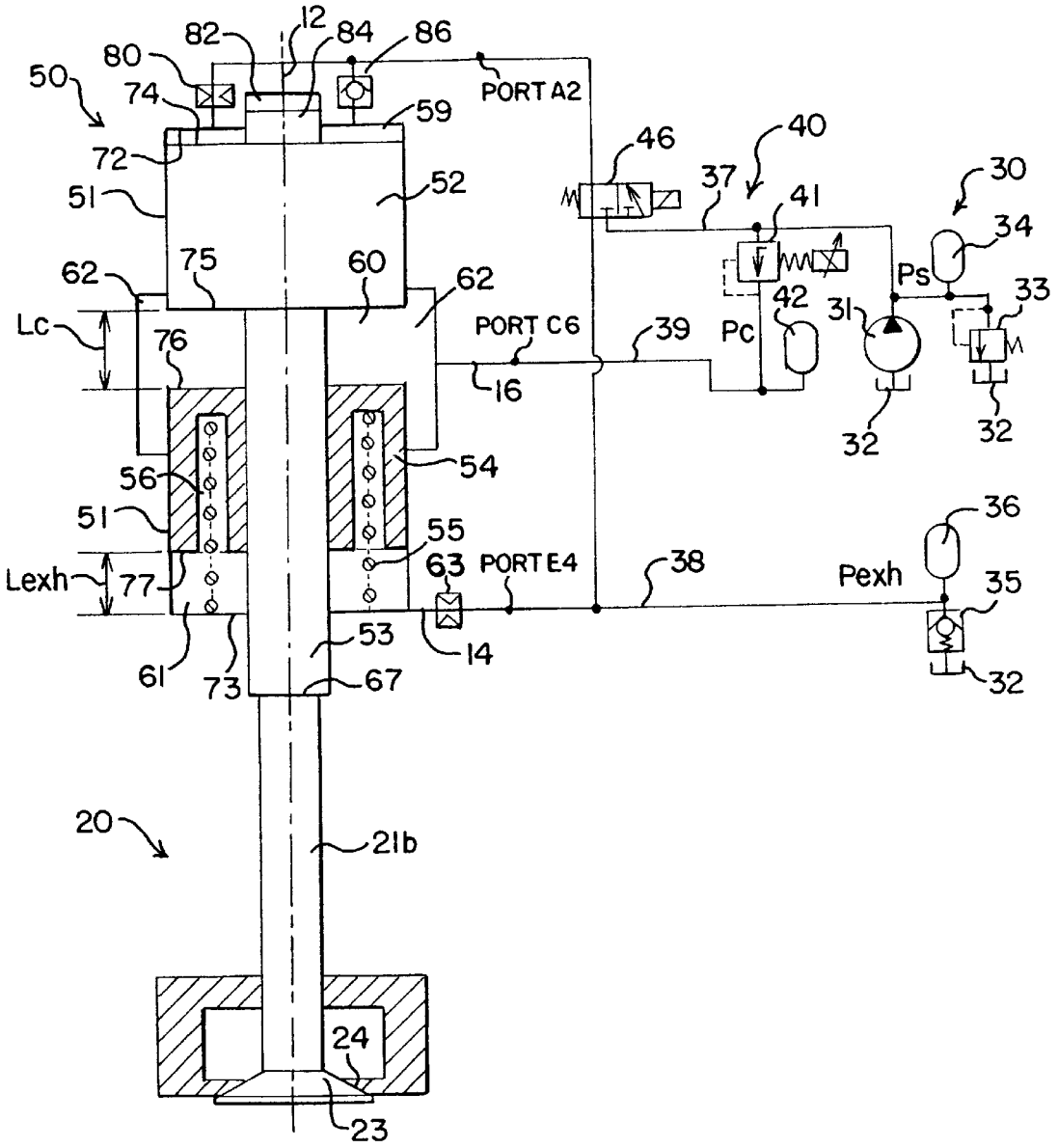
FIG. 9 is a schematic illustration of an alternative embodiment of the actuator without a return spring.

Refer now to FIG. 9, which is a drawing of another preferred embodiment of the invention. The main physical difference between this embodiment and that illustrated in FIG. 1 is lack of the return spring 22 in FIG. 9. This embodiment is feasible if the control pressure Pc, acting at the bottom of the actuation piston 52, is strong enough even at Pc min to ensure a speedy valve closing and yet weak enough even at Pc max to ensure a speedy valve opening. Also the ends 67 of the piston rod 53 and engine valve stem 21 have to be mechanically tied together so that the piston rod 53 can pull up the engine valve stem 21 during the return motion. When the return spring 22 in FIG. 1 is used, it accumulates potential energy during the opening stroke and releases it during the closing stroke. The same can also be accomplished with hydraulic fluid under the control pressure Pc through a proper sizing of the control pressure accumulator 42, if used. This is also made easier when an engine has multiple cylinders with staggered timing for openings and closings, resulting in lower peak flow demands.

Figure 10:
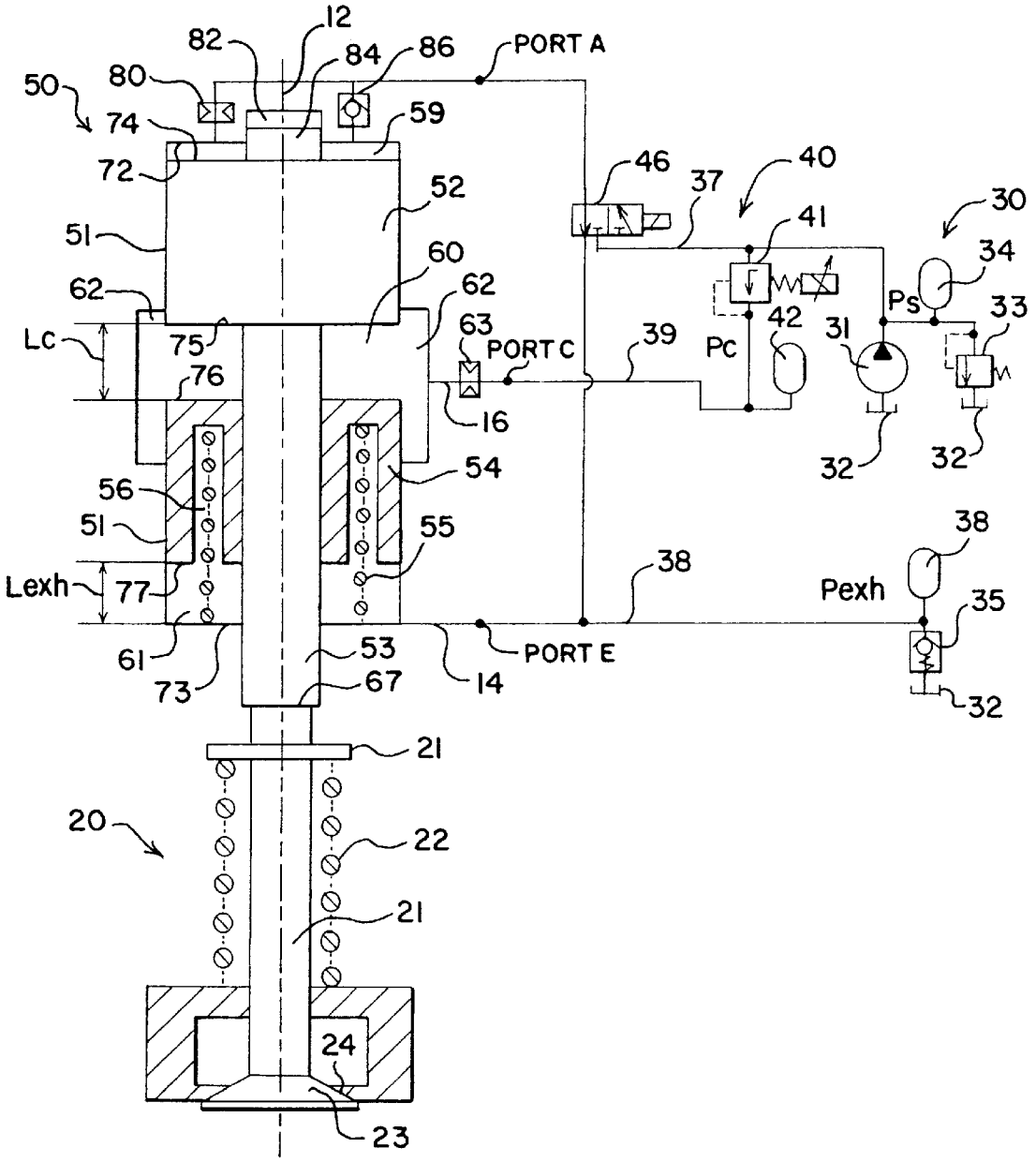
FIG. 10 is a schematic illustration of an alternative embodiment of the actuator having a control spring disposed under the control piston and a flow restrictor applied to the control port.
Figure 17A:
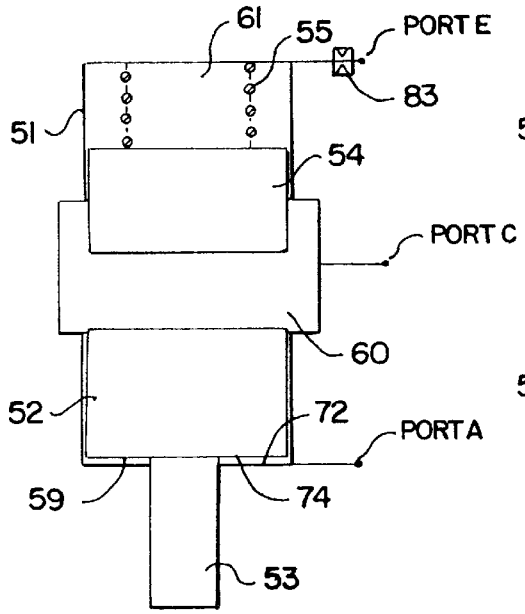
FIG. 17A is a schematic illustration of an alternative embodiment of the actuator with a piston rod connected to a first side of an actuation piston.
Figure 17B:
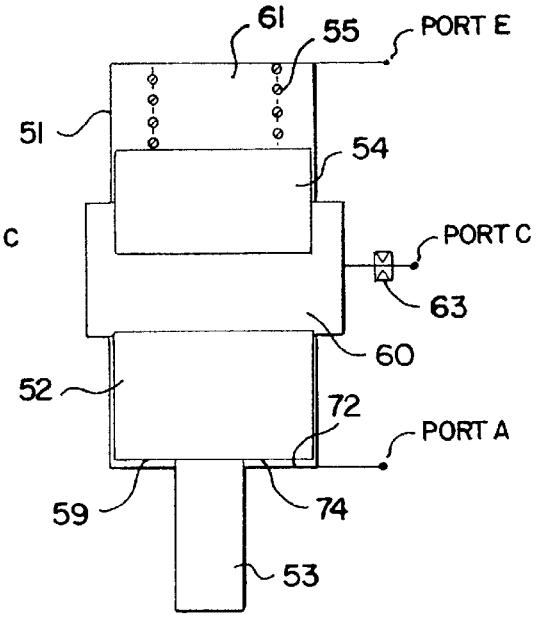
FIG. 17B is a schematic illustration of an alternative embodiment of the actuator with a piston rod connected to a first side of an actuation piston and with a flow restrictor applied to the control port.

Refer now to FIGS. 10 and 17B, which are illustrations of other preferred embodiments of the invention. In this embodiment, the lift flow restrictor 63 is applied to the fluid flow passageway leading to port C, instead of port E as shown in FIGS. 1 and 17A. With the flow restriction applied to port C, the volume of the control chamber 60 stays the substantially unchanged during either opening or closing strokes. The control piston 54 thus substantially follows the actuation piston 52 during dynamic movements while its nominal position is still controlled by the control pressure Pc. It thus can be imagined that the two pistons 54 and 52 travel together as a single large piston. The travel of this imaginary large piston is limited by the exhaust chamber height Lexh at rest, which in turn is controlled by the control pressure Pc as shown in FIG. 10. The exhaust chamber height Lexh is complementary to the control chamber height Lc. Mathematically, Lexh+Lc=Lev max. If Lc=0, Lexh=Lev max. If Lc=Lev max, Lexh=0. Therefore the relationship shown in FIG. 11 between the engine valve lift Lev and the control pressure Pc for this embodiment of FIG. 10 is opposite to the relationship shown in FIG. 6 for an earlier embodiment of FIG. 1. If again Pc min=Pexh+Fo/Acp and Pc max=Pexh+(Fo+Kcs Lev max)/Acp, Lev=Lev max when Pc≦Pc min, Lev=0 when Pc≧Pc max, and Lev=Lev max−

Figure 11:
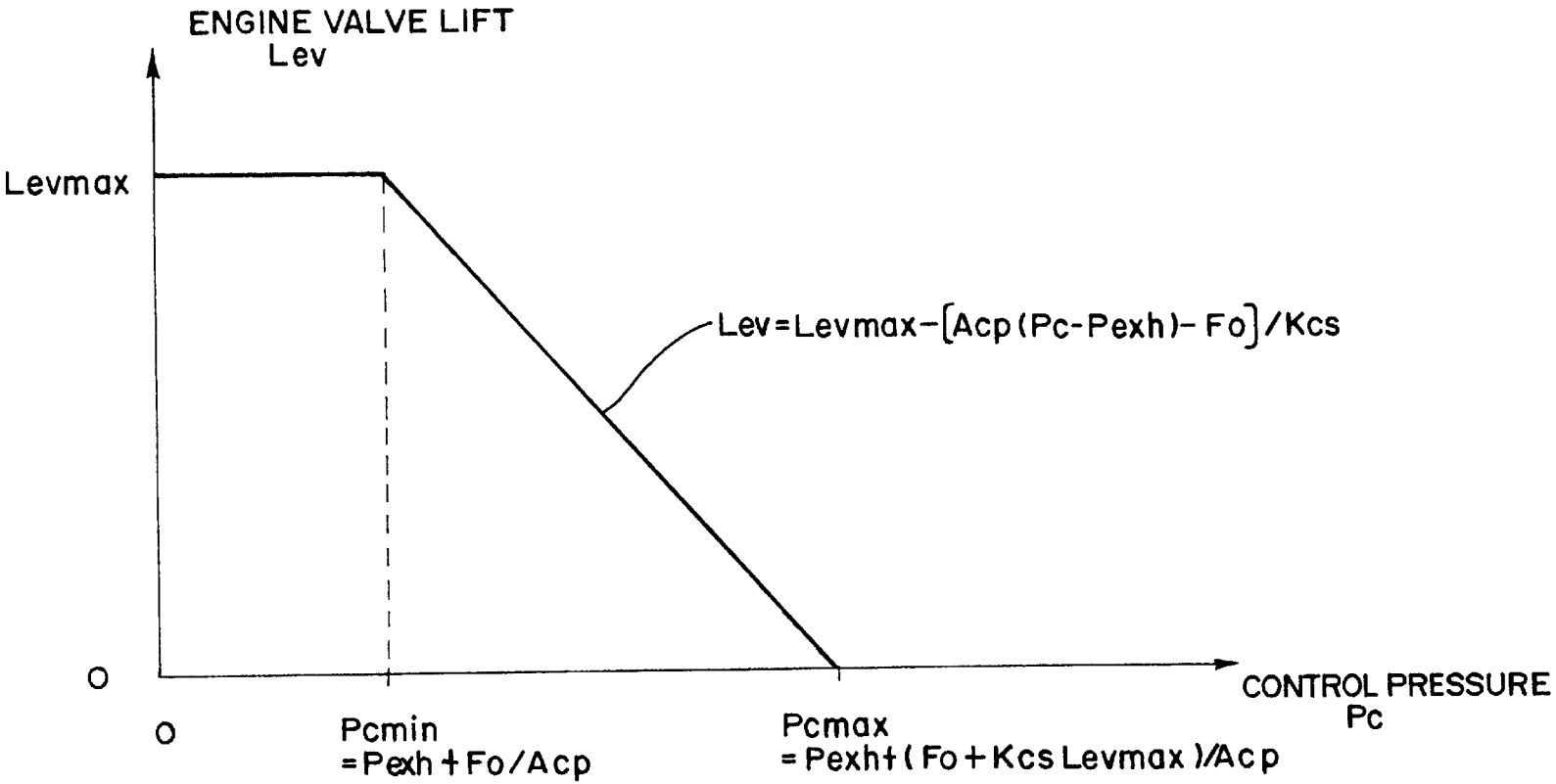
FIG. 11 is a graph illustrating the relationship between engine valve lift Lev and control pressure Pc for the embodiments shown in FIGS. 10 and 13.

(Acp (Pc−Pexh)−Fo)/Kcs when Pc min<Pc<Pc max. Therefore within the control range between Pc min and Pc max, the engine valve lift Lev is inversely proportional to the control pressure Pc as shown in FIG. 11. If the return spring 22 is not used, the closing force is transferred from the control spring 55, to the control piston 54, to hydraulic fluid in the control chamber 60, and finally to the actuation piston 52.

Referring now to FIGS. 12, 13, 17C and 17D, which are other preferred embodiments of this invention, the control port or port C and exhaust port or port E are switched relative to their positions in the two embodiments shown in FIGS. 1 and 10 and in the two embodiments shown in FIGS. 17A and 17B. In FIGS. 12, 13, 17C, and 17D, port C is near one end of the cylinder 51*c* or 51*d* along the axis while port E is around the center of the cylinder 51*c* or 51*d*. Accordingly, to balance the control pressure force from the control chamber 60*c*, 60*d* side of the control piston 54*c* or 54*d*, the control spring 55*c* or 55*d* is relocated between the two pistons to act on the exhaust chamber 60*c*, 60*d* side of the control piston 54*c* or 54*d*. The two embodiments in FIGS. 12 and 13, and in FIGS. 17D and 17C, differ, among themselves, in the location of the lift flow restrictor 63*c* or 63*d*, which is at port E and port C, respectively.

Figure 12:
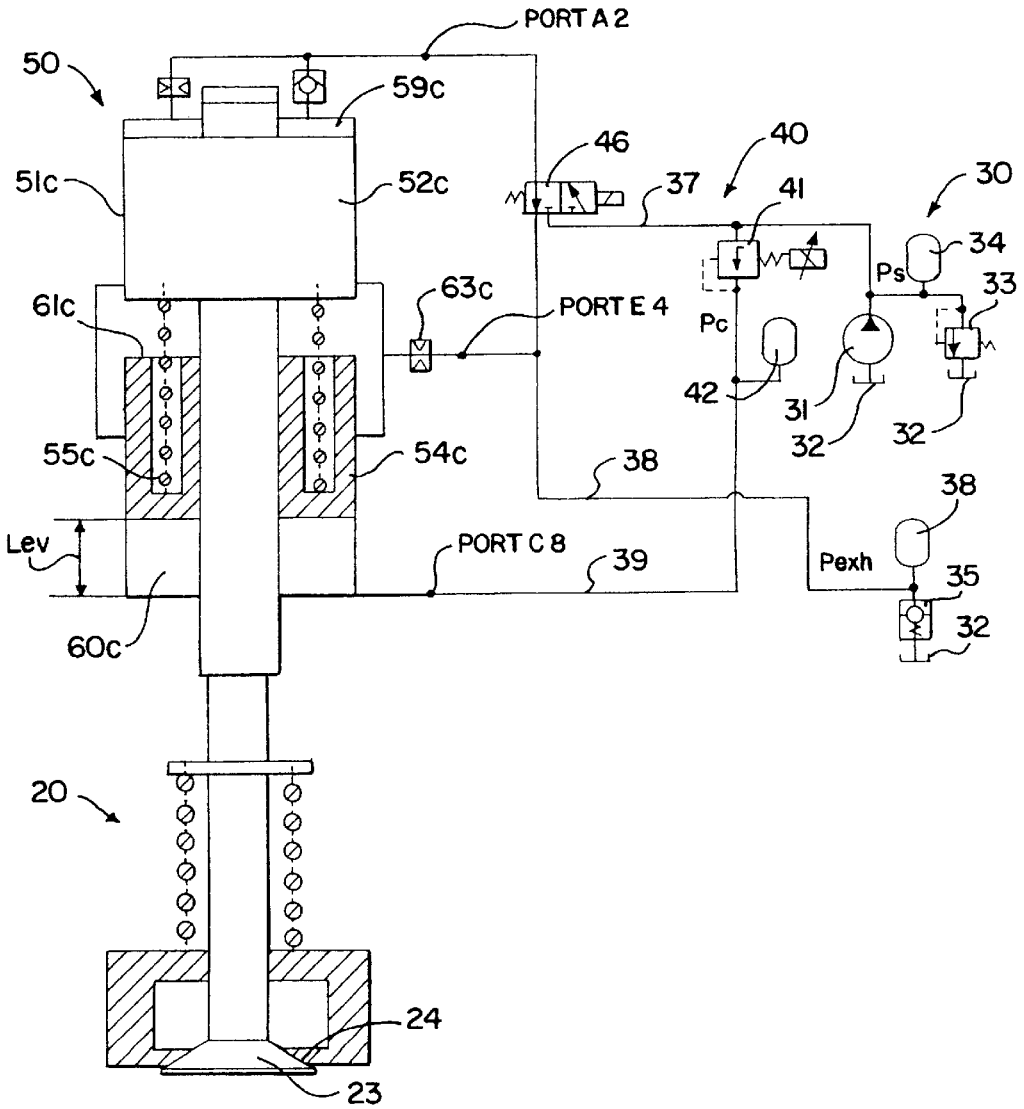
FIG. 12 is a schematic illustration of an alternative embodiment of the actuator having the control spring disposed between an actuation piston and a control piston, and with the flow restrictor applied to the exhaust port.
Figure 17C:
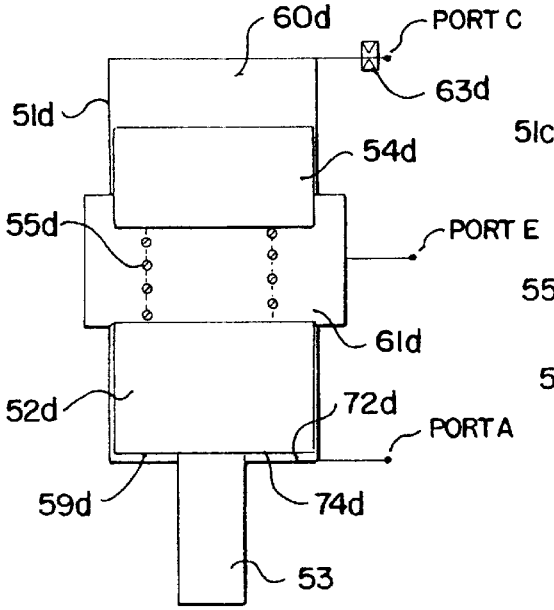
FIG. 17C is a schematic illustration of an alternative embodiment of the actuator with a piston rod connected to a first side of an actuation piston, with the control spring disposed between the actuation and control pistons and with the flow restrictor applied to the control port.
Figure 17D:
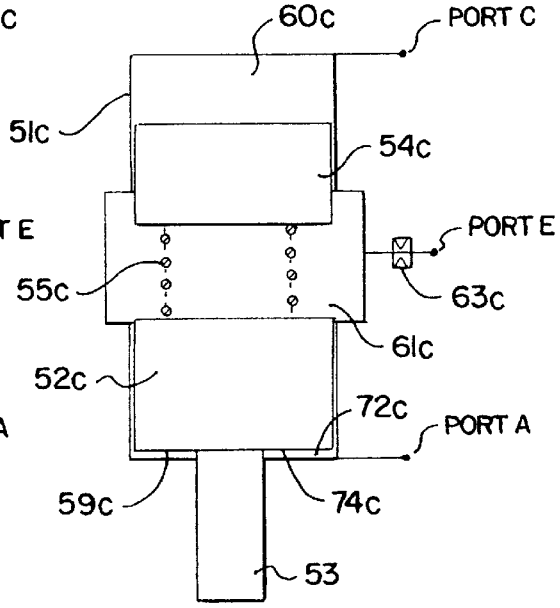
FIG. 17D is a schematic illustration of an alternative embodiment of the actuator with a piston rod connected to a first side of an actuation piston and with the control spring disposed between the actuation and control pistons.
Figure 19:
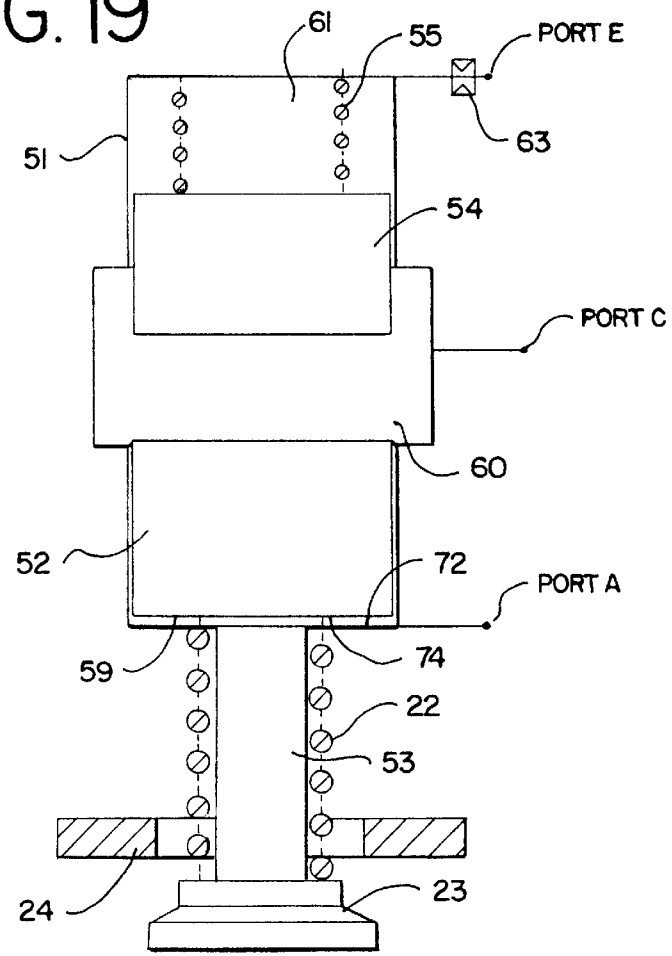
FIG. 19 is a schematic illustration of an alternative embodiment of the actuator with a piston rod connected to a first side of an actuation piston and a valve positioned in an open position.

In operation of the embodiments shown in FIGS. 12 and 17D, the fluid volume in the exhaust chamber 61 c remains substantially constant during the opening, dwell, and closing periods because of the lift flow restrictor 63*c* at port E. The two pistons 52*c* and 54*c* move together dynamically. Therefore, the engine valve lift Lev, as shown in FIG. 12, is equal to the control chamber height Lc, which is proportional to the control pressure Pc. Functionally, this embodiment is similar to that shown in FIG. 1. If the return spring 22 is not used, the closing force is transferred from the control pressure Pc in the control chamber 60*c*, to the control piston 54*c*, to hydraulic fluid in the exhaust chamber 61*c* and the control spring 55*c*, and finally to the actuation piston 52*c*.

Figure 13:
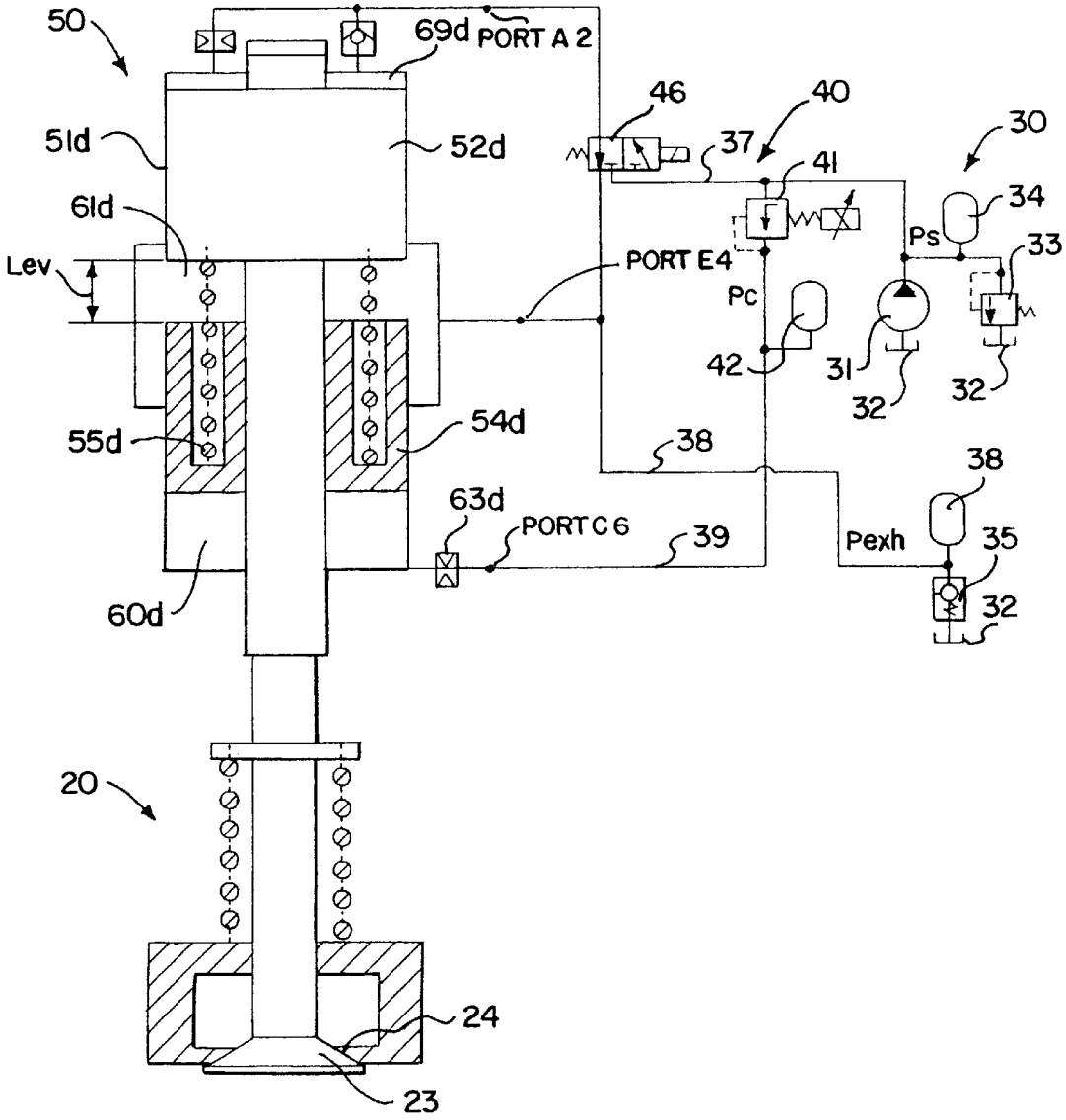
FIG. 13 is a schematic illustration of an alternative embodiment of the actuator having the control spring disposed between the actuation and control pistons and the flow restrictor applied to the control port.

In operation of the embodiments shown in FIG. 13 and 17C, the fluid volume in the control chamber 60*d* remains substantially constant during the opening, dwell, and closing periods because of the lift flow restrictor 63*d* at port C. The control piston 54*d* remains substantially stationary during the dynamic operation of the system. Therefore, the engine valve lift Lev, as shown in FIG. 13, is equal to the exhaust chamber height Lexh, which is inversely proportional to the control pressure Pc. Functionally, this embodiment is similar to that shown in FIG. 10. If the return spring 22 is not used, all the closing force is from the control spring 55*d* to the action piston 52*d*.

As summarized in FIG. 14, the four preferred embodiments illustrated in FIGS. 1, 10, 12 and 13 result from four different combinations of various positioning of the control spring and the lift flow restrictor. The engine valve lift Lev is proportional to the control pressure Pc when the lift flow restrictor is applied to port E and is inversely-proportional to the control pressure Pc when the lift flow restrictor is applied to port C. The control pressure Pc itself is controlled by the electrohydraulic pressure regulator 41, which as shown in FIG. 1 is incidentally, per hydraulic graphic convention, an inversely-proportional regulator, with the output pressure being inversely-proportional to the control electric current in its solenoid. One can also select an electrohydraulic pressure regulator of the other proportionality (not shown here). For some applications, it may be preferred to have the engine valve lift Lev equal to its maximum value to keep the engine running for the safety reason when the pressure control electric current is cut off by accident. This inverse relationship between the electric current and the engine valve lift can be achieved by either combining an inversely-proportional hydraulic actuator and a proportional electrohydraulic pressure regulator or combining a proportional hydraulic actuator and an inversely-proportional electrohydraulic pressure regulator. If in another application engine valves need to be closed when the control electric current is off, it can be implemented by either combining an inversely-proportional hydraulic actuator and an inversely-proportional electrohydraulic pressure regulator or combining a proportional hydraulic actuator and a proportional electrohydraulic pressure regulator.

There are other alternatives to the electrohydraulic pressure regulators illustrated in FIGS. 1, 9, 10, 12 and 13 that provide a controlled pressure source. For example, instead of getting fluid from the supply line 37, reducing its pressure to a lower level, and wasting energy, it is quite practical for example to have a servo hydraulic pump (not shown here) that delivers hydraulic fluid at the desired pressure directly by an appropriate feedback means.

Another important feature of an engine valve actuation system is its effective inertia. In two of the four embodiments summarized in FIG. 14, the control piston does not move dynamically with the actuation piston, resulting in a faster response for the actuation piston and engine valve assembly. One of these two embodiments has a restricted port E plus a bottom control spring as shown in FIG. 1 with details, and the other embodiment has a restricted port C plus a middle control spring as shown in FIG. 13 with details. In either of these two embodiments with details in FIGS. 1 and 13, the actuator can be considered to consist of one conventional piston and one cylinder with a variable piston stroke limiter stopper. In either of the two other embodiments with details in FIGS. 10 and 12, the actuation and control pistons move together dynamically, and the actuator can be considered to consist of one piston with a variable height and one conventional cylinder.

All four embodiments summarized in FIG. 14 can be designed without a return spring, in which case the engine valve closing force is either from the control pressure Pc for the embodiments with a restricted port E or from the control spring for the embodiments with a restricted port C.

Figure 15:
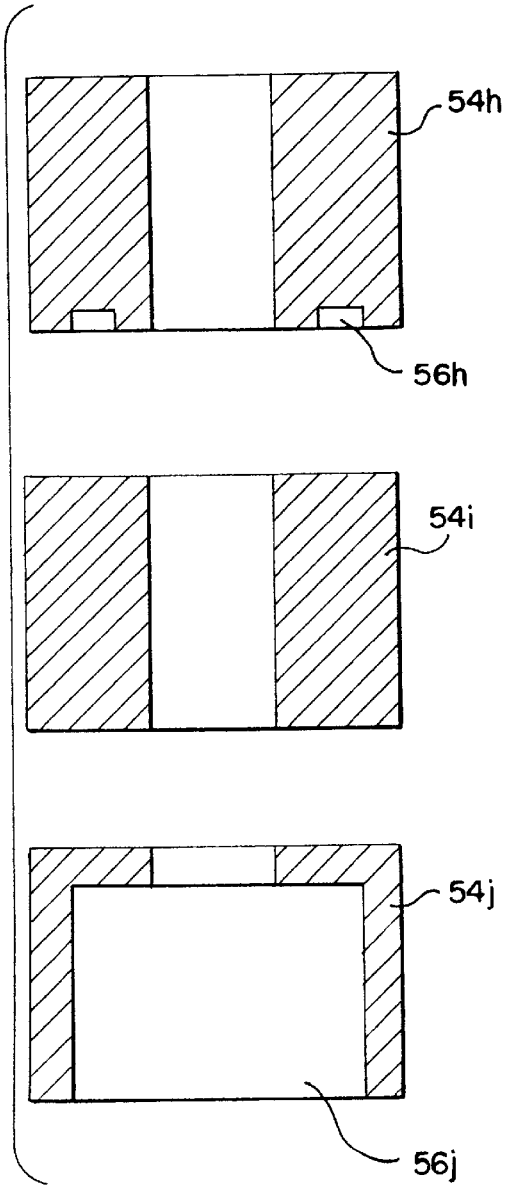
FIG. 15 is partial cross-sectional view of various alternative control piston designs.
Figure 16:
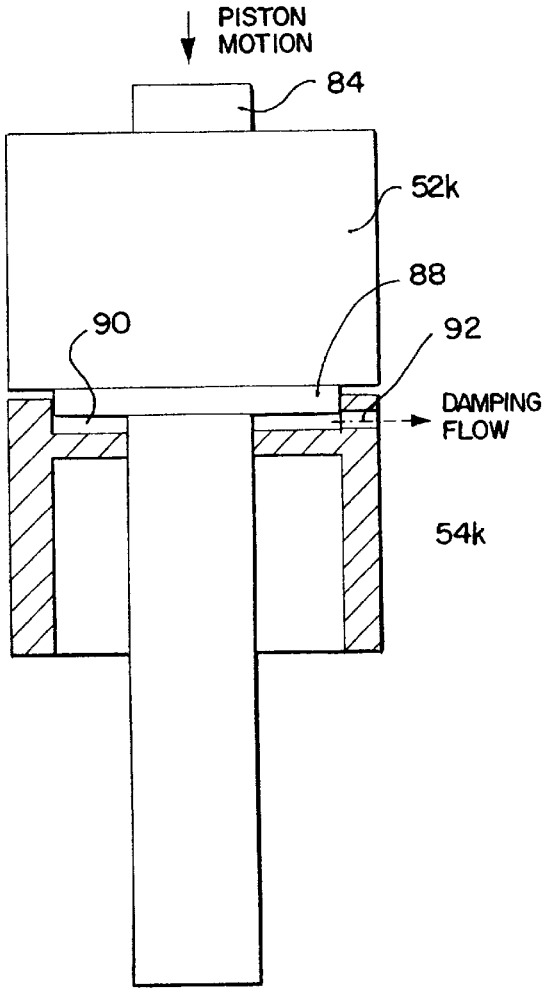
FIG. 16 is a cross-sectional view of a damping mechanism applied between the actuation piston and the control piston.

Other than the design shown in FIG. 1, the control piston 54 can have physical shapes as shown in FIG. 15. If there is enough packaging space along the axis of the actuator 50, the groove 56*h* can be much shallower, or the actuation piston 54*i* can be a solid ring. The actuation piston 54*j* can also have a cavity 56*j* as shown in FIG. 15 for easier fabrication. In some applications, a top cavity 90 or recess and a damping orifice 92 are added to the top of the control piston 54*k* as shown in FIG. 16. The cavity and orifice work with a bottom protrusion 88, or insert portion, at the bottom of the actuation piston 52*k* to function as a damping mechanism to reduce impact force between the two pistons 52*k* and 54*k*. Alternatively, the cavity and orifice can be formed at the bottom of the control piston, with a protrusion formed on the cylinder. As the actuation piston 52*k* moves downward, or in a first direction, close to the control piston 54*k* , the bottom protrusion or insert portion 88 squeezes into the top cavity or recess 90 and forces working fluid out through the damping orifice 92, resulting in a rising pressure inside the top cavity 90 to slow the impact. The depth of the top cavity 90 is also made to be more than the height of the bottom protrusion 88 so that after the impact, the pressure in the top cavity 90 or in between the two pistons 52*k* and 54*k* is substantially equal to the pressure of the fluid chamber in the middle portion of the fluid cylinder, be it the control chamber or exhaust chamber, through the damping orifice 92.

The cushion check valve 86 is a one-directional valve and is primarily used to open the actuation chamber 59 to port A during the early phase of the opening stroke when the connection between the actuation chamber 59 and the cushion cavity 82 is blocked by the cushion protrusion 84. The valve 86 may be eliminated if considering relatively slow velocity and thus low flow rate at the early phase of the opening stroke. This low flow rate might be accommodated by the cushion flow restrictor 80 without too much pressure drop. Once the cushion protrusion 84 is out of the cushion cavity 82 a short period into the opening stroke, the actuation chamber 59 is wide open to port A through the cushion cavity 82. Even the cushion flow restrictor 80 might be eliminated with an appropriate design of the diametrical clearance and axial engagement between the cushion protrusion 84 and the cushion cavity 82. One can also add taper or individual groves along the axis of the cushion protrusion 84 to achieve desired cushion effects during the late phase of the closing stroke and to supply sufficient flow during the early phase of the opening stroke. There are many other practical ways of doing damping in a hydraulic cylinder. It is not the intention of this disclosure to describe them all in details.

Whereas either the control spring 55 or the return spring 22 is generally depicted to be a single compression, coil spring, they are not necessarily limited so. Either of the springs can include a plurality of springs, or can comprise one or more other spring mechanisms.

Also in many illustrations and descriptions, the fluid medium is defaulted to be hydraulic or of liquid form, and it is not limited so. The same concepts can be applied with proper scaling to pneumatic actuators and systems. As such, the term "fluid" as used herein is meant to include both liquids and gases.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An actuator comprising:

a cylinder defining a longitudinal axis and comprising a first and second end;

a first port communicating with said first end of said cylinder, a second port communicating with said second end of said cylinder, and a third port communicating with said cylinder between said first and second ends;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston; and a control spring biasing said control piston in at least one of said first and second directions, wherein said control spring biases said first side of said control piston.

2. The invention of claim 1 wherein said control spring is disposed between said first side of said control piston and said second side of said actuation piston.

3. An actuator comprising:

a cylinder defining a longitudinal axis and comprising a first and second end;

a first port communicating with said first end of said cylinder, a second port communicating with said second end of said cylinder, and a third port communicating with said cylinder between said first and second ends;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

a control spring biasing said control piston in at least one of said first and second directions; and a first chamber formed between said first end of said cylinder and said first side of said actuation piston, a second chamber formed by said second side of said control piston and said second end of said cylinder, a third chamber formed between said second side of said actuation piston and said first side of said control piston, a first fluid flow passageway between said first port and said first chamber, a second fluid flow passageway between said second port and said second chamber, and a third fluid flow passageway between said third port and said third chamber.

4. The invention of claim 3 wherein said control spring biases said second side of said control piston.

5. The invention of claim 4 wherein said control spring is disposed between said second side of said control piston and said second end of said cylinder.

6. The invention of claim 3 wherein said third fluid flow passageway is more restrictive to fluid flow than said second fluid flow passageway.

7. The invention of claim 3 wherein said second fluid flow passageway is more restrictive to fluid flow than said third fluid flow passageway.

8. The invention of claim 3 wherein said cylinder has a first portion having an inner diameter dimensioned to receive said actuation piston, a second portion having an inner diameter dimensioned to receive said control piston, and a third portion having an inner diameter greater than said inner diameters of said first and second portions, wherein said second portion communicates with said second fluid flow passageway.

9. The invention of claim 3 wherein there is no substantial fluid communication among said first, second and third chambers.

10. The invention of claim 3 wherein at least one of said second and third fluid flow passageways comprises a short orifice.

11. The invention of claim 3 wherein at least one of said second and third fluid passageways is adapted to allow fluid to flow in a first and second direction, wherein said at least one of said second and third fluid passageways is more restrictive to the fluid flow in said first direction than in said second direction.

12. The invention of claim 11 wherein at least one of said second and third fluid passageways comprises an orifice and a one-way valve arranged in a parallel relationship.

13. The invention of claim 3 further comprising a cushion device acting between said first side of said actuation piston and said first end of said cylinder.

14. The invention of claim 13 wherein said cushion device comprises a blocking portion of said actuation piston blocking at least a portion of said first fluid flow passageway as said first side of said actuation piston is positioned proximate said first end of said cylinder, wherein the fluid flow in said first fluid flow passageway is substantially restricted.

15. The invention of claim 14 wherein said first fluid flow passageway comprises a primary first fluid flow passageway and at least one secondary first fluid flow passageway, wherein said at least one secondary first fluid flow passageway is more restrictive to fluid flow than said primary first fluid flow passageway, and wherein said blocking portion blocks at least a portion of said primary first fluid flow passageway.

16. The invention of claim 13 wherein said first fluid flow passageway comprises a plurality of said first fluid flow passageways, and wherein said cushion device comprises a one-way valve disposed in at least one of said plurality of said first fluid flow passageways.

17. A fluid control system comprising the actuator of claim 3, wherein at least one of said second and third ports communicates with a control pressure fluid source.

18. The invention of claim 17 further comprising a pressure regulator regulating a pressure of the control pressure fluid source.

19. A fluid control system comprising the actuator of claim 3, wherein at least one of said second and third ports communicates with a low pressure source.

20. The invention of claim 3 wherein at least one of said second side of said control piston and said second end of said cylinder comprise a recess.

21. The invention of claim 20 wherein said recess is in fluid communication with said second port even when said second side of said control piston is in contact with said second side of said cylinder.

22. A control system for controlling an actuator comprising:

a cylinder defining a longitudinal axis and comprising a first and second end;

a first port communicating with said first end of said cylinder, a second port communicating with said second end of said cylinder, and a third port communicating with said cylinder between said first and second ends;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston; and a control spring biasing said control piston in at least one of said first and second directions;

wherein the first port communicates with a fluid supply system supplying a fluid, wherein said fluid supply system comprises a switch operable between at least a first and second position, wherein said fluid supply system supplies said fluid at a high pressure when said switch is in the first position, and wherein said fluid supply system supplies said fluid at a low pressure when said switch is in the second position.

23. A control system for an engine valve comprising:

a cylinder defining a longitudinal axis and comprising a first and second end;

a first port communicating with said first end of said cylinder, a second port communicating with said second end of said cylinder, and a third port communicating with said cylinder between said first and second ends;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

a control spring biasing said control piston in at least one of said first and second directions; and a piston rod connected to said second side of said actuation piston and extending through an opening in said control piston, wherein said piston rod is connected to at least one engine valve.

24. An actuator comprising:

a cylinder defining a longitudinal axis and comprising a first and second end;

a first port communicating with said first end of said cylinder, a second port communicating with said second end of said cylinder, and a third port communicating with said cylinder between said first and second ends;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston; and a control spring biasing said control piston in at least one of said first and second directions;

wherein at least one of said first side of said control piston and said second side of said actuation piston comprise a recess.

25. The invention of claim 24 wherein said recess is in fluid communication with said third port even when said first side of said control piston is in contact with said second side of said actuation piston.

26. The invention of claim 24 further comprising at least one insert portion extending from at least one of said first side of said control piston and said second side of said actuation piston mating with said recess.

27. An actuator comprising:

a cylinder defining a longitudinal axis and comprising a first and second end;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

an actuation chamber formed between said first end of said cylinder and said first side of said actuation piston, an exhaust chamber formed by said second side of said control piston and said second end of said cylinder, and a control chamber formed between said second side of said actuation piston and said first side of said control piston;

a first fluid flow passageway communicating with said actuation chamber, a second fluid flow passageway communicating with said exhaust chamber, and a third fluid flow passageway communicating with said control chamber, wherein said second fluid flow passageway is more restrictive to fluid flow than said third fluid flow passageway; and a control spring disposed between said second side of said control piston and said second end of said cylinder.

28. An actuator comprising:

a cylinder defining a longitudinal axis and comprising a first and second end;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

an actuation chamber formed between said first end of said cylinder and said first side of said actuation piston, an exhaust chamber formed by said second side of said control piston and said second end of said cylinder, and a control chamber formed between said second side of said actuation piston and said first side of said control piston;

a first fluid flow passageway communicating with said actuation chamber, a second fluid flow passageway communicating with said exhaust chamber, and a third fluid flow passageway communicating with said control chamber, wherein said third fluid flow passageway is more restrictive to fluid flow than said second fluid flow passageway; and a control spring disposed between said second side of said control piston and said second end of said cylinder.

29. An actuator comprising:

a cylinder defining a longitudinal axis and comprising a first and second end;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

an actuation chamber formed between said first end of said cylinder and said first side of said actuation piston, a control chamber formed between said second side of said control piston and said second end of said cylinder, and an exhaust chamber formed between said second side of said actuation piston and said first side of said control piston;

a first fluid flow passageway communicating with said actuation chamber, a second fluid flow passageway communicating with said control chamber, and a third fluid flow passageway communicating with said exhaust chamber, wherein said third fluid flow passageway is more restrictive to fluid flow than said second fluid flow passageway; and a control spring disposed between said first side of said control piston and said second side of said actuation piston.

30. An actuator comprising:

a cylinder defining a longitudinal axis and comprising a first and second end;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

an actuation chamber formed between said first end of said cylinder and said first side of said actuation piston, a control chamber formed between said second side of said control piston and said second end of said cylinder, and an exhaust chamber formed between said second side of said actuation piston and said first side of said control piston;

a first fluid flow passageway communicating with said actuation chamber, a second fluid flow passageway communicating with said control chamber, and a third fluid flow passageway communicating with said exhaust chamber, wherein said second fluid flow passageway is more restrictive to fluid flow than said third fluid flow passageway; and a control spring disposed between said first side of said control piston and said second side of said actuation piston.

31. A method of controlling an actuator comprising:

providing an actuator comprising:

a cylinder defining a longitudinal axis and comprising a first and second end;

a first port communicating with said first end of said cylinder, a second port communicating with said second end of said cylinder, and a third port communicating with said cylinder between said first and second ends;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

a first chamber formed between said first end of said cylinder and said first side of said actuation piston, a second chamber formed between said second side of said control piston and said second end of said cylinder, and a third chamber formed between said second side of said actuation piston and said first side of said control piston; and a control spring engaging said second side of said control piston;

applying a first pressure to said first side of said actuation piston in said first chamber with a fluid moving through said first port;

moving said actuation piston in said first direction in response to said application of said first pressure;

applying a second pressure to said second side of said actuation piston in said third chamber with a fluid moving through said third port;

engaging said first side of said control piston with said second side of said actuation piston;

applying a third pressure to said second side of said control piston in said second chamber with a fluid moving through said second port; and biasing said second side of said control piston with said control spring.

32. The invention of claim 31 wherein said first pressure is greater than said second pressure.

33. The invention of claim 31 further comprising removing said first pressure and applying a fourth pressure to said first side of said actuation piston in said first chamber with a fluid moving through said first port.

34. The invention of claim 33 further comprising biasing said second side of said actuation piston with a return spring.

35. The invention of claim 34 wherein said actuation piston comprises a piston rod connected to said second side of said actuation piston, and wherein said biasing said second side of said actuation piston comprises biasing said piston rod with said return spring.

36. The invention of claim 33 further comprising disengaging said first side of said control piston with said second side of said actuation piston.

37. A method of controlling an actuator comprising:

providing an actuator comprising:

a cylinder defining a longitudinal axis and comprising a first and second end;

a first port communicating with said first end of said cylinder, a second port communicating with said second end of said cylinder, and a third port communicating with said cylinder between said first and second ends;

an actuation piston disposed in said cylinder and moveable along said longitudinal axis in a first and second direction, said actuation piston comprising a first and second side;

a control piston disposed in said cylinder, said control piston moveable along said longitudinal axis in a first and second direction and comprising a first and second side, wherein said first side of said control piston faces said second side of said actuation piston;

a first chamber formed between said first end of said cylinder and said first side of said actuation piston, a second chamber formed between said second side of said control piston and said second end of said cylinder, and a third chamber formed between said second side of said actuation piston and said first side of said control piston; and a control spring disposed between said control piston and said actuation piston;

applying a first pressure to said first side of said actuation piston in said first chamber with a fluid moving through said first port;

moving said actuation piston in said first direction in response to said application of said first pressure;

applying a second pressure to said second side of said actuation piston in said third chamber with a fluid moving through said third port;

biasing said first side of said control piston with said control spring engaged with said second side of said actuation piston; and applying a third pressure to said second side of said control piston in said second chamber with a fluid moving through said second port.

38. The invention of claim 37 wherein said first pressure is greater than said third pressure.

39. The invention of claim 37 further comprising engaging said second end of said cylinder with said second side of said control piston.

40. The invention of claim 39 further comprising disengaging said second side of said control piston with said second end of said cylinder.

41. The invention of claim 38 further comprising removing said first pressure and applying a fourth pressure to said first side of said actuation piston in said first chamber with a fluid moving through said first port.

42. The invention of claim 41 further comprising biasing said second side of said actuation piston with a return spring.

43. The invention of claim 42 wherein said actuation piston comprises a piston rod connected to said second side of said actuation piston, and wherein said biasing said second side of said actuation piston comprises biasing said piston rod with said return spring.

* * * * *